US006863094B2

(12) United States Patent
Ensor

(10) Patent No.: US 6,863,094 B2
(45) Date of Patent: Mar. 8, 2005

(54) BAG FILLING APPARATUS FOR BAGGING PARTICULATE MATTER

(75) Inventor: Mark E. Ensor, San Jose, CA (US)

(73) Assignee: Ensor Equipment, Inc., San Jose, CA (US)

( * ) Notice: Subject to any disclaimer, the term of this patent is extended or adjusted under 35 U.S.C. 154(b) by 0 days.

(21) Appl. No.: 10/346,592

(22) Filed: Jan. 17, 2003

(65) Prior Publication Data

US 2003/0140983 A1 Jul. 31, 2003

Related U.S. Application Data

(62) Division of application No. 09/442,556, filed on Nov. 18, 1999, now Pat. No. 6,598,374.

(51) Int. Cl.[7] ..... B65B 43/04

(52) U.S. Cl. ..... 141/10; 141/166; 141/181; 141/263; 141/314

(58) Field of Search ..... 141/10, 114, 129, 141/153, 165, 166, 181–183, 263, 264, 281, 282, 313–317

(56) References Cited

U.S. PATENT DOCUMENTS 3,739,522 A * 6/1973 Greenbaum ..... 53/455
3,807,125 A * 4/1974 Enrich ..... 53/450
4,512,136 A * 4/1985 Christine ..... 53/410
4,630,310 A * 12/1986 Winesett ..... 383/37
5,007,233 A * 4/1991 Bose ..... 383/37
5,337,539 A * 8/1994 Barton ..... 53/455
5,452,564 A * 9/1995 Staats ..... 53/450
5,687,551 A * 11/1997 Mustain et al. ..... 53/468
5,771,665 A * 6/1998 Nelson et al. ..... 53/459
5,893,260 A * 4/1999 McKenna ..... 53/451
5,944,424 A * 8/1999 Lerner et al. ..... 383/37

* cited by examiner

*Primary Examiner*—J. Casimer Jacyna
(74) *Attorney, Agent, or Firm*—Larry B. Guernsey; Intellectual Property Law Offices

(57) ABSTRACT

Methods and apparatuses for filling flexible receptacles or bags with bulk or particulate material is provided. In one aspect, an automatic sand bag filling apparatus is disclosed which includes a bulk fill channel which may be placed within the interior of each bag to be filled. The filling apparatus may have a metering device for providing the desired amount of bulk material to the fill channel. The fill channel may be moveable along a fixed path for engaging and advancing a series of interconnected bags. Articulating spreader bars may be provided to support the bag during filling. In one embodiment, the filling apparatus is mounted on a trailer assembly and includes a reservoir for storing the bulk sand. The sand may be transferred from the reservoir to the filling apparatus using augers, conveyors, etc. A preferred construction of a series of interconnected sand bags and a method of making a series of interconnected bags is also disclosed.

24 Claims, 29 Drawing Sheets

BAG FILLING APPARATUS FOR BAGGING PARTICULATE MATTER

This application is a divisional of application Ser. No. 09/442,556 which was filed on Nov. 18, 1999 now U.S. Pat. No. 6,598,374.

FIELD OF THE INVENTION

The present invention relates generally to methods and apparatuses for filling bulk particulate into flexible receptacles such as bags or the like, and more particularly to an automated system for dispensing bulk sand into a plurality of flexible receptacles which may be used, for example, to erect barriers to control flood waters.

BACKGROUND OF THE INVENTION

In a number of circumstances, it is desirable to produce large quantities of particulate filled flexible receptacles or bags for distribution or placement as desired. For example, large numbers of sandbags are used each year to protect real and personal property from the harmful and erosive effects of flooding occurring in and around our oceans, lakes, rivers, and other waterways.

Most commonly, sand bags are prepared by manually filling each bag using a shovel or other manual device. Typically, each bag is then manually closed using drawstrings, manual ties, or by twisting or tying the top material of the bag. Examples of manual filling apparatuses for filling bags with sand are disclosed, for example, in U.S. Pat. Nos. 5,845,685; 5,802,807; and 5,687,781. Such manual devices are quite slow and labor intensive, typically requiring a large number of workers to produce a relatively modest number of filled sandbags.

It is most often the case, however, that the exigent circumstances precipitated by rising flood waters leave insufficient time to manually produce the number of filled sand bags that will be required to erect the necessary temporary dams or barriers to control or divert the flooding waters. Further complications arise from the reality that, for a given localized community under floodwater conditions, sand bags may be required at a number of different locations. There is a need, therefore, for transportable sand bag filling systems capable of rapidly producing a large quantity of sand bags at a desired emergency site with minimal manual labor requirements.

Semi-automated sand bagging systems which help to reduce the amount of time and labor required to produce filled sand bags are known in the art. Most often, these semi-automated sand bagging systems require one or more operators to manually present and hold or secure the bags, either individually or in groups, in position with respect to some sort of mechanized filling apparatus. See, for example, U.S. Pat. Nos. 4,044,921; 4,184,522; 5,873,396; and 5,806,576.

Other sand bagging systems having somewhat higher degrees of automation have been disclosed. For example, U.S. Pat. No. 5,893,260 discloses a sand bag filling apparatus which automatically excavates, forms, fills and discharges sandbags. The sand bags are formed and sealed during the filling process at the point of fill material introduction from bag material which is stored on two continuous roll fed webs. The apparatus disclosed in the '260 patent requires operator directed excavation from a source of fill material and does not disclose provisions for the use of pre-formed sand bags of simple construction.

In another example, U.S. Pat. No. 5,771,665 discloses a sand bagging system which fills bags extracted from a specially prepared cassette. The cassette apparatus generally includes a set of rails which support a plurality of sand bags held on the rails by tabs which are in turn attached to ribbons. The bag cassettes are manually loaded onto the rails of the filling system and the ribbons fed through tensioning rollers. The bags, supported on the rails by the tabs are then withdrawn from the cassette by the ribbons, filled, and then severed from the rails to be sewn shut and discharged from the system.

The cassettes required by the apparatus disclosed in the '665 patent, however, require relatively complex and specially manufactured bags having tabs, ribbons, and rails adding considerable difficulty to the manufacture and storage of the bags and cassettes. Further, since an automatic sand bagging machine may consume over 100,000 bags over the course of a single day of full-time operation, any extra features, hardware, or like complexities which add cost to the bag will result in considerable aggregate expense as great numbers of bags are rapidly consumed. This is especially true as flooding emergencies may require several days of continuous operation.

In view of the foregoing, it would be desirable to have a sand bag filling apparatus or system that is capable of filling a large number of bags or receptacles in a short amount of time with minimal operator intervention. It would be further desirable to have a sand bag filling apparatus which is capable of running continuously for an extended period of time without operator assistance and which is portable or mobile to allow deployment to a desired location. It would also be desirable to have a sand bag that is of simple construction, allows efficient storage of a large number of pre-manufactured bags, and facilitates automatic loading and filling by a suitably constructed sand bag filling apparatus.

SUMMARY OF THE INVENTION

The present invention will be generally described with respect to preparing filled sand bags for use in erecting flood barriers, but the invention is not limited thereto, and is contemplated to be useful for filling various flexible receptacles or bags with a wide range of bulk materials.

The present invention involves various aspects of an automated bag filling system or apparatus for filling flexible receptacles or bags with a bulk material, such as sand. The filling systems or apparatuses of the present invention facilitate the filling of large numbers of bags with the desired material with little or no operator intervention. In certain preferred embodiments, the automatic sand bag filling system operates to deposit a desired amount of bulk material in each bag, closes or seals shut the filled bag, and releases the bag from the filling system for placement in service according to its intended use.

One aspect of the present invention involves a sand bag filling machine for filling a bag with sand which may include a fill channel having an open end and an interior sized to hold a predetermined amount of sand. The fill channel may be moveable along a fixed path from a first position exterior of the bag to a second position wherein at least a portion of the fill channel is positioned within the interior of the bag. In one embodiment, the sand bag filling machine includes a lift assembly for controllably moving the fill channel between the first and second position.

The sand bag filling machine may include a metering device adapted to deposit the predetermined amount of sand through the open end of the fill channel and into the interior of the fill channel. According to one aspect of the present invention, the metering device comprises a moveable tray having a bottom member. The bottom member may have at least one opening and a plate member substantially covering the opening when the moveable tray is in a first position. The moveable tray may be moveable relative to the plate member to a second position in which the opening is positioned at least partially over the open end of the fill channel and at least a portion of the opening is no longer covered by the plate member. As the plate member is removed or cleared from the opening, the sand is allowed to fall into the open end. In a preferred embodiment, the plate member moves in with the bottom member for a portion of the stroke of the bottom member so that the opening is positioned further out over the open end before sand is released.

In one embodiment, the bottom member includes a contiguous bottom portion adjacent the opening and the moveable tray further includes an input opening for receiving a substantially continuous supply of sand. The supply of sand is directed onto the plate member when said moveable tray is in a first position and onto the contiguous bottom portion when the moveable tray is in the second position. This arrangement effectively converts a continuous flow of sand into charges of sand at desired intervals.

The sand bag filling may have a pair of spreader bars or members to help support the bags during certain operations such as filling, cutting, or closing. The spreader members are preferably elongate members which are cylindrical or other suitable shape and are generally disposed in a parallel configuration. In one embodiment, the spreader members are moveably coupled to a support member which is moveable from a first position wherein said the spreader members are positioned exterior of the bag to be filled and a second position wherein at least a portion of the spreader members are positioned within the interior of the bag. At least one of the spreader bars, and preferably both, are moveable relative to the other whereby the first and second spreader members may be spread apart relative to each other while positioned within the bag.

The fill channel may have a substantially cylindrical, square, or other generally closed cross-section. The open end of the fill channel may be funnel shaped or otherwise have a transition section having angled sides to direct the sand towards a bottom or second end of the fill channel. The second end of the fill channel preferably has at least one opening or outlet through which sand within the interior of the fill channel is allowed to exit into the interior of the bag. The sand remains substantially contained within the fill channel until the channel is withdrawn from the bag. Preferably, a substantial portion of the sand exits the interior through the opening when the fill channel is moving from its second position to its first position.

Another aspect of the present invention involves an automatic sand bag filling system comprising a plurality of interconnected bags each having a bag opening and a bag interior, a fill channel, and a metering device, such as a moveable tray, adapted to deposit a desired amount of sand within the inlet opening. Each of the plurality of bags have a top portion and a bottom portion, the top portion of each of the bags being connected to the bottom portion of a next adjacent bag. The end-to-end interconnection of the bags facilitates easy routing and presentation of the bags through the sand bag filling system.

The fill channel may have a first end with an inlet opening for receiving sand, a second end having an outlet opening, and a substantially open or unobstructed interior region between the inlet opening and the outlet opening. The fill channel is preferably moveable between at least a first position exterior of one of the bags placed at a first location, a second position wherein at least a portion of the fill channel is positioned within the interior region of the one bag, and a third position wherein the one bag is displaced by operation of the fill channel to a second location. The fill channel may also be moveable to a fourth position wherein the fill channel is exterior the one bag at a second location. As the fill channel moves from the third position to the fourth position, a substantial portion of the sand exits the fill channel through the outlet opening. Thus, this configuration advantageously uses the fill channel to both advance each bag from a first location to a second filling location and to reliably fill the bag with sand.

In one preferred embodiment, the first location of each sand bag is preferably substantially vertically above the second location where the bag is filled. The first location and the second location are preferably separated by a distance substantially equal to the length of the bags. The first, second, third, and fourth positions of the fill channel are preferably in a substantially straight line, although the mechanism used to produce the movement may result in curvilinear or other such motion. Preferably, the sand bag filling system includes a lift assembly having a carriage controllably positionable along a fixed vertical path corresponding with the first, second, third, and fourth positions of the fill channel. The fill channel may be operably connected to the carriage which operates to raise and lower the fill channel. A similar carriage and lift arrangement is preferably provided to raise and lower the spreader bars.

The sand bag filling apparatus may be mounted to a truck, tractor, or trailer to allow it to be easily transported to a desired location. Preferably, the automatic sand bag filling system further includes a trailer assembly having at least two wheels to facilitate towing behind an appropriate tow vehicle. The trailer assembly further comprises a reservoir or hopper sized to hold a sufficient quantity of sand so as to fill a plurality of sand bags. More preferably, the hopper hold sufficient sand to allow the apparatus to fill bags with sand for an extended amount of time. One or more bulk transfer devices such as augers or conveyors or the like may be provided to distribute sand from the hopper to the metering device.

Another aspect of the present invention involves a method for filling a series of bags with particulate material. The method may include the steps of providing a plurality of bags connected in an end-to-end fashion, each of the bags having a bag opening and a bag bottom; providing a fill channel having first end having a first end having an inlet opening, a second end having an outlet opening, and a substantially open interior therebetween; placing at least a portion of the second end within the interior of one of the bags such that the outlet opening is in close proximity to the bag bottom; depositing a desired amount of particulate matter within the interior of the fill channel; and withdrawing the fill channel from within the interior of the bag to release the amount of particulate matter from the interior of the fill channel and into the interior of the bag to fill the bag with the amount of particulate matter.

After the bag has been filled, the method may include the step of cutting the filled bag from a next bag adjacent thereto. The method may include the step of mechanically closing the bag opening, for example, by way of sewing, stapling, gluing, heat sealing, or other suitable closure means or mechanism. As or after the one bag is being filled, cut, and/or closed, the method may include the steps of placing at least a portion of the second end within the interior of a next adjacent bag and urged against the bag bottom of the next bag, moving the fill channel to cause the second end of the fill channel to displace the next bag from a first position to a second position, and depositing a second desired amount of particulate matter within the interior of the fill channel. The second position of the next bag is essentially the same position as was used to fill the previous bag.

Another aspect of the present invention involves an interconnected series of bags for use in an automatic sand bag filling apparatus, the interconnected bags comprising a plurality of bags formed along a length of substantially continuous web material. Each of the plurality of bags having a front panel and a back panel, the back panel being integral with the web material. Each of the plurality of bags being separated by a connecting portion of web material.

In a preferred embodiment, the back panel and the connecting portion of the plurality of bags are integrally formed from the length of continuous web material. Each of the plurality of bags preferably have a bag opening and the front panel further includes a flap folded over along at least a portion of the bag opening. The flap of each of the plurality of bags may be folded to the outside or inside of each bag, preferably to the inside. The bag material may include any suitable bay material, but is preferably selected from the group consisting of burlap, polypropylene and rice paper.

Another aspect of the present invention involves a method of forming an interconnected series of bags comprising the steps of (a) providing a length of web material having a first edge and a second edge; (b) making first and second L-shaped cuts extending from the first edge toward the center to create first and second flaps of material within the web; (c) folding the first flap of material onto the web material and securing it thereto; (d) folding the web material between the first cut and the second cut lengthwise to substantially align the first edge to the second edge; (e) sealing the folded web along the first edge and the second edge to create a bag side and sealing along the second cut to create a bag bottom; and (f) repeating steps (b) through (e) whereby a series of interconnected bags are formed. The steps involving sealing may be accomplished by sewing, stapling, gluing, heat sealing, or other suitable fixing or fastening technique. The interconnected series of bags are preferably arranged in an alternating fan-fold arrangement on a pallet.

These and other features of the present invention will become more fully apparent from the following description and appended claims.

DETAILED DESCRIPTION

Figure 1:
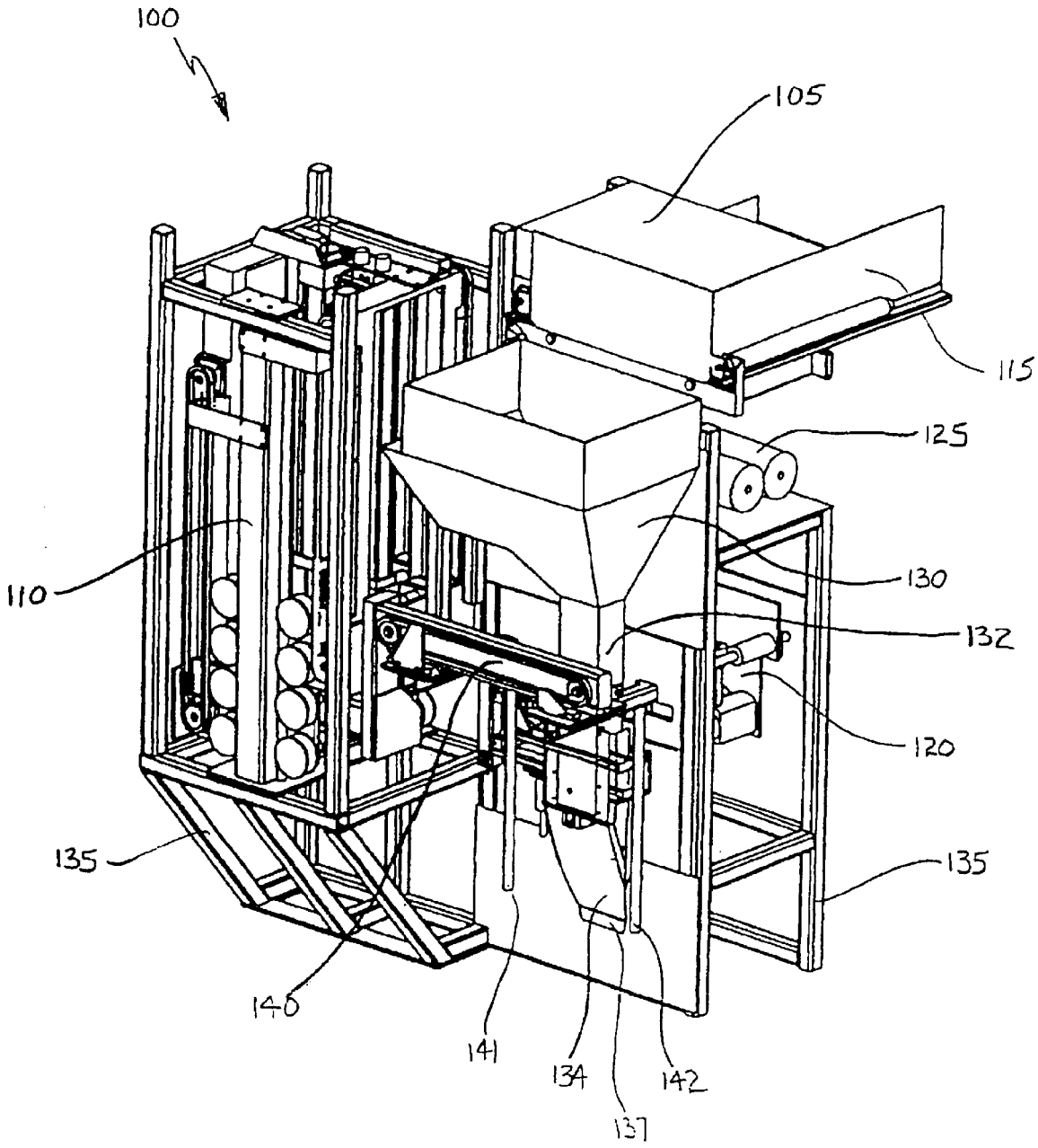
FIG. 1 is a perspective view illustrating an automatic bag filling apparatus constructed according to the principles of the present invention.

The present invention involves an automated bag filling system or apparatus for rapidly filling large numbers of flexible receptacles or bags with aggregate, particulate, or other bulk material. The filling system of the present invention is capable of filling a plurality of bags with the desired material with minimal operator intervention. The filling system preferably consistently presents each bag in a suitable position and orientation to facilitate the placement of a predetermined amount of bulk material within each bag. The filling system preferably has a construction which allows the filled bag to be closed or sealed shut and released from the filling system for subsequent routing or delivery. By way of example only, typical bulk materials may include sand, gravel, dirt, coal, wood chips, grains, or other bulk food, agricultural, manufacturing, and mining materials.

The flexible receptacles or bags may be supplied to the filling system in an interconnected configuration. As such, the bags may be easily routed through the filling system in a substantially continuous fashion. When the bags are supplied in an interconnected configuration, they are preferably connected in an end to end fashion using any suitable connector or connecting mechanism either formed from the bag material itself or from a separate material such as string, wire, clips, rings, etc. which may be attached to adjacent bags to form the desired interconnection. In a preferred embodiment, the bags may be formed on or from a common continuous web of material.

The filling system may be configured in a variety of ways to accommodate a wide range of uses. For example, the filling system may be in the form of a substantially stationary apparatus which may be operated at a predetermined site. Such a configuration may be advantageously integrated into a manufacturing or processing line to provide an inline module for bulk packaging of a wide range of processed or manufactured bulk materials, components, or products. In another example, the filling system may be configured as a mobile system which may be transported to and operated at different sites as may be required. Such a mobile configuration allows for bulk packaging at remote locations such as may be advantageous for packaging agricultural or mining products at or near the point of harvest or excavation.

In one embodiment, the present invention is adapted to fill bags with sand or the like for use in erecting flood barriers or other such structures. The filling system is preferably mobile to allow the filling system to service a large geographic flood area which may require filled sand bags at numerous or changing locations. The filling system may be mounted on a truck, tractor, trailer, or like apparatus to allow it to be moved from location to location. Preferably, the filling system is fixed to a trailer type frame which may towed to an operating site by way of a suitable tow vehicle.

Referring to the figures wherein like numerals indicate like elements, the structure and operation of a preferred automatic bag filling system is shown in FIGS. 1–24. For purposes of example only, the automatic bag filling system will be described in the context of filling bags with sand, but the invention is not limited thereto. Automatic sand bag filling system 100 is preferably constructed to receive and fill a series of interconnected bags with a bulk material, preferably sand or the like. Automatic sand bag filling system 100 preferably sequentially engages and presents each sand bag in a position or orientation that facilitates the automated filling of the sand bag through one or more bag openings. Preferably, the sand bags are bound on three sides or edges and have a single bag opening along all or part of a fourth side or edge.

Once filled with a desired amount of sand or other bulk material, the bag is preferably separated from the adjacent bag to which it was interconnected and the bag opening is closed shut by way of a tying, sewing, stapling, heat sealing, gluing, or other suitable operation or mechanical fastener which is appropriate for the particular material and construction of the bag being used. The filled sand bag may then be taken from the machine and placed into service according to its intended use.

Figure 2:
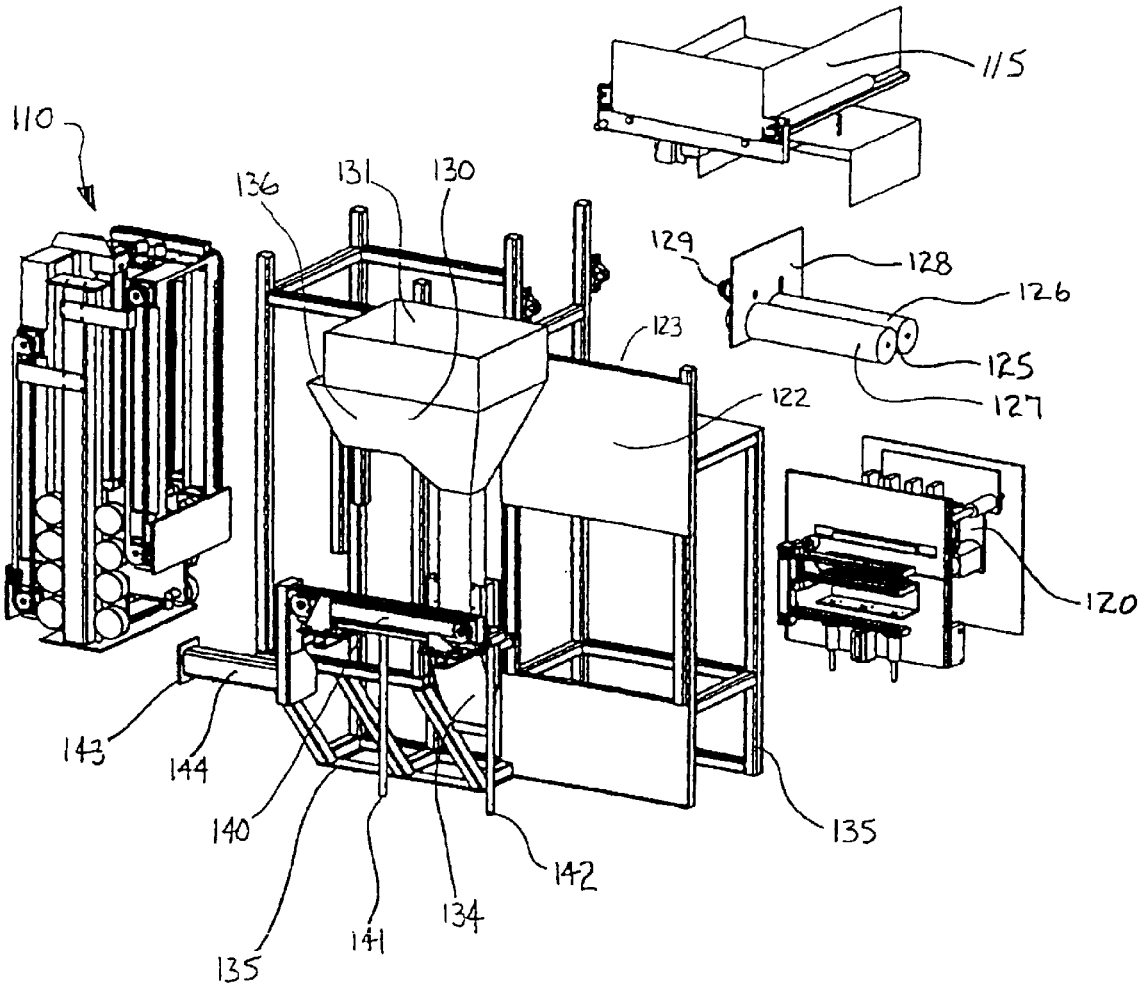
FIG. 2 is an exploded view illustrating the automatic bag filling apparatus of FIG. 1.

Referring to FIGS. 1 and 2, frame 135 supports the main components or subsystems of automatic sand bag filling system 100. In general, automatic sand bag filling system 100 preferably has a sand delivery assembly for delivering a desired amount of sand, a fill hopper assembly for receiving and directing the sand to the interior of a bag, a bag release mechanism for releasing the filled bag from an interconnected adjacent bag, and a closure assembly for closing or sealing the opening of the filled sand bag.

Fill hopper assembly 130 preferably has a fill channel with a funnel shaped opening. In one embodiment, fill hopper assembly 130 has top opening 131 and transition portion 136 which leads into fill channel or conduit 132 having a terminal end 133 having an opening through which the sand may be released into the bag. At least an end portion of fill channel 132 is preferably directed to be placed within the interior of each bag to be filled.

Most preferably, terminal end 133 of fill channel 132 is placed at or near the bottom of each bag. When sand is deposited into fill hopper assembly 130 through top opening 131, the deposited sand is generally held within fill channel 132 which has been placed within the bag to be filled. Fill channel 132 may then be removed from within the interior of the bag leaving sand in place within the bag. Constraining the sand within fill channel 132 in this manner provides an extremely reliable and repeatable fill without subjecting the bag itself to undesirably high dynamic loading forces which would otherwise be encountered.

Fill channel 132 may be placed and removed from within each bag in any convenient manner. For example, the bags could be placed on an elevator or articulating mechanism which raises or moves the bag relative to a stationary fill hopper assembly. More preferably, fill hopper assembly 130 is controllably moveable relative to the bags between a first or filling position (see, for example FIG. 1) and a second or raised position (see, for example, FIG. 9). Fill channel 132 is shown in place within sand bag 151 in FIG. 3. As will be described in detail below, fill hopper 130 is controllably moved along a generally vertical trajectory or fixed path preferably by operation of telescopic lift assembly 110.

To allow sand to be introduced into fill hopper assembly 130 at any time without regard to whether the terminal end is properly positioned at or near the bottom of the sand bag to be filled, terminal end 133 may have a valve or controllable door 134 which substantially blocks or closes the opening or outlet at terminal end 133. Controllable door 134 allows any sand deposited into top opening 131 to be kept within fill channel 132 until such time that fill channel 132 is properly positioned at or near the bottom of a sand bag. At that time, door 134 may be opened and fill hopper assembly withdrawn from the interior of the sand bag to leave the desired amount of sand deposited within the sand bag. Door 134 is preferably actuated between open and closed positions using any suitable mechanical actuator including air cylinders, hydraulic cylinders, electric solenoids, motors, etc.

Figure 3:
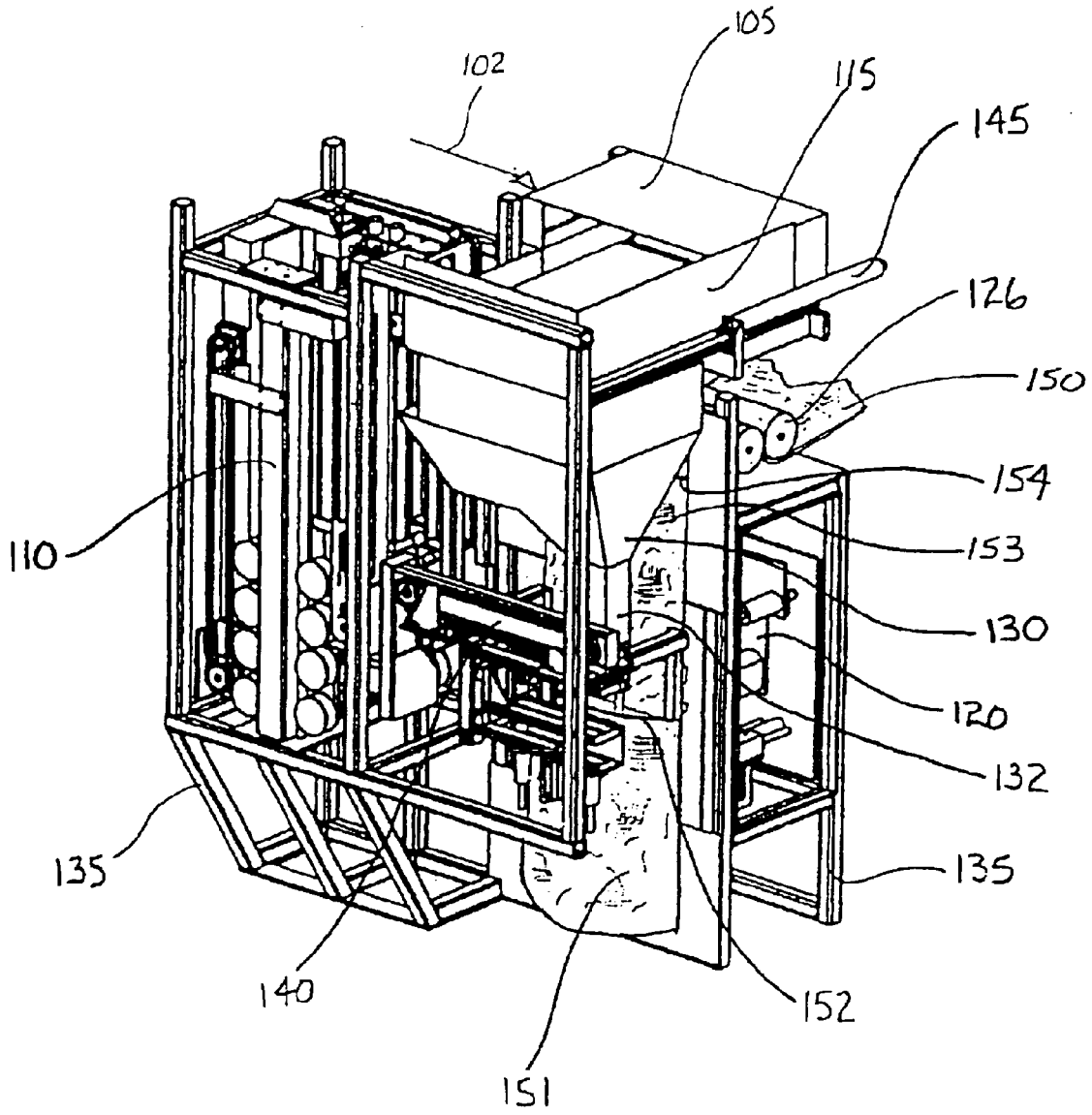
FIG. 3 is a perspective view illustrating the automatic bag filling apparatus in a filling position with a preferred bag in place for filling.
Figure 4A:
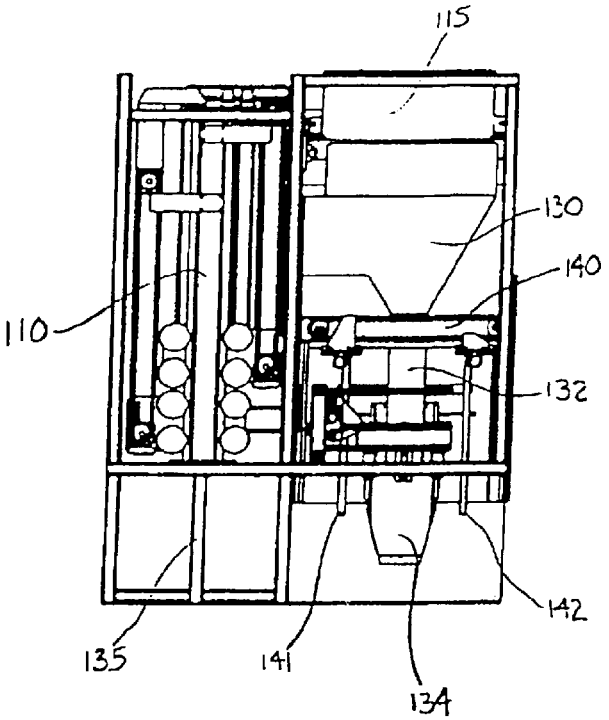
FIGS. 4A and 4B are front and side views, respectively, illustrating the automatic bag filling apparatus in the fill position.
Figure 4B:
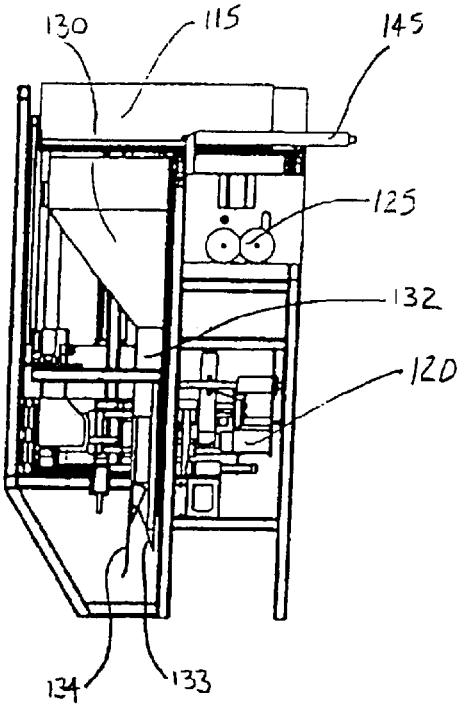
Figure 5:
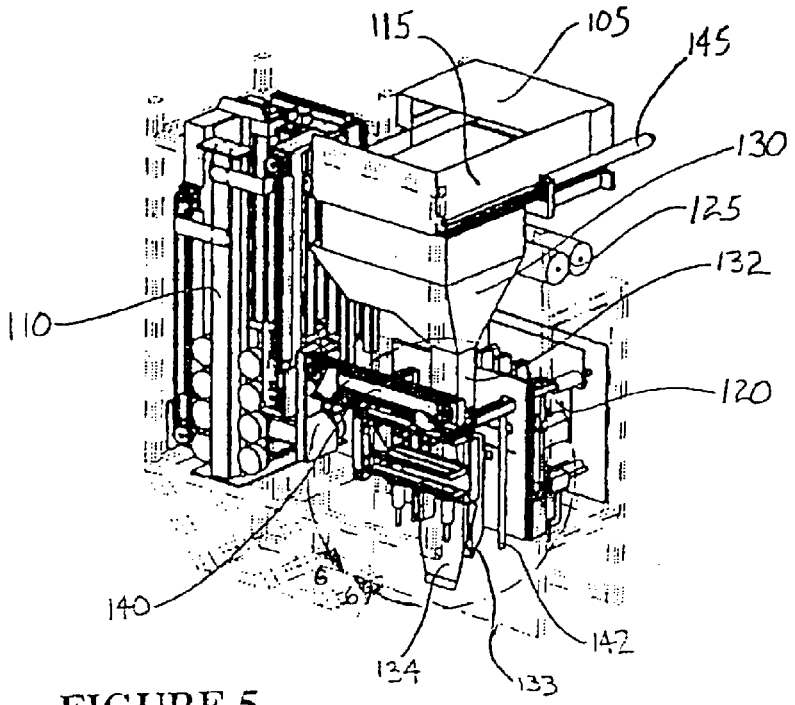
FIG. 5 is a perspective view illustrating the automatic bag filling apparatus in the filling position with the frame shown in phantom lines for clarity.
Figure 6:
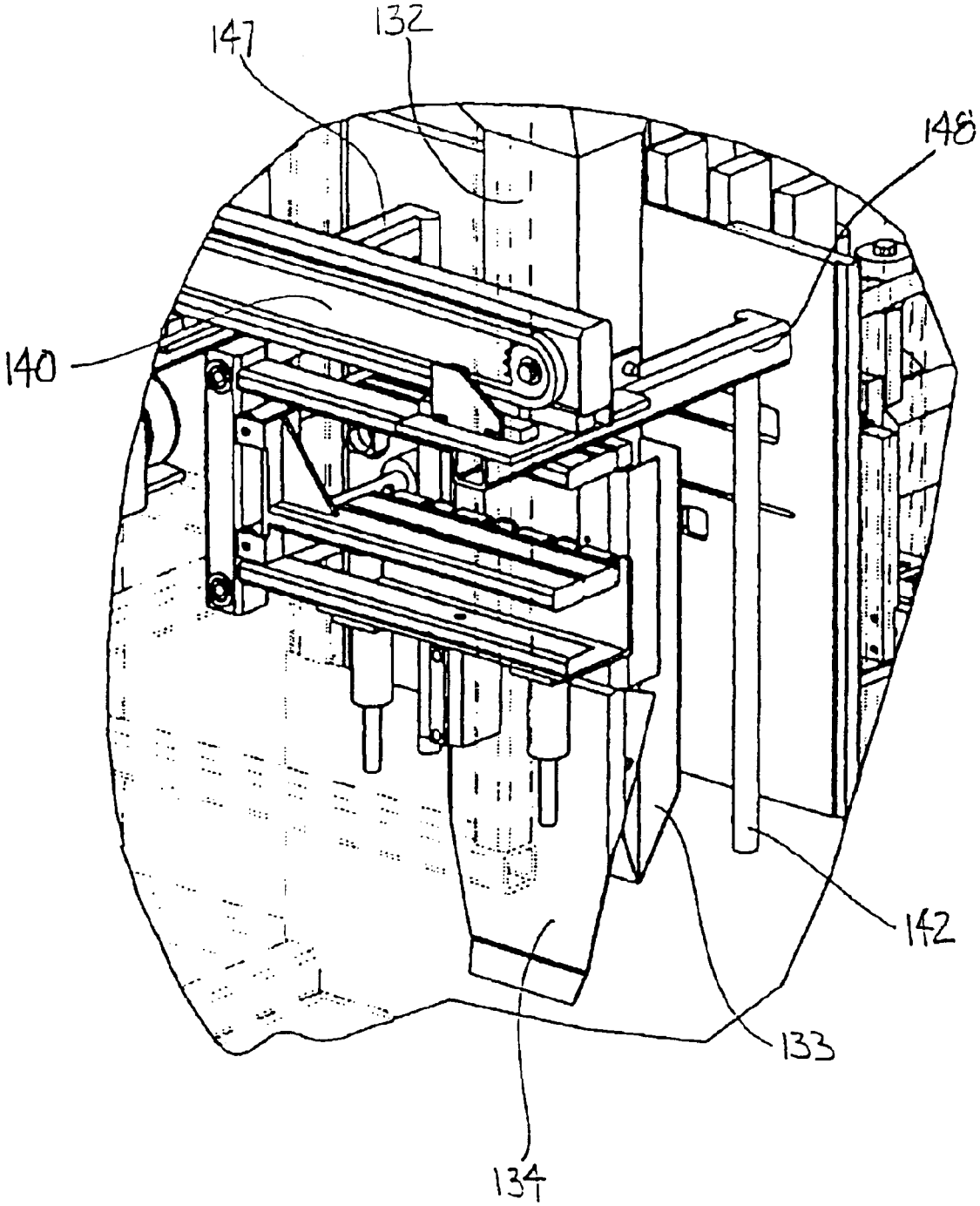
FIG. 6 is a detail view of the area of the automatic filling apparatus generally indicated by line 6—6 in FIG. 5.

The sand bags are preferably supplied in the form of a generally continuous series of interconnected bags. As seen in FIG. 3, a plurality of bags may be configured end to end to form continuous strip or web 150. Web 150 may be routed from a supply or source (not shown) into automatic sand bag filling system 100 where each bag of web 150 may be sequentially engaged by fill hopper assembly 130 and filled with sand. Automatic sand bag filling system 100 preferably includes back plate 122 having guide edge 123 for supporting web 150 in a generally vertical orientation coincident with the path of the fill hopper assembly 130.

Each sand bag of web 150 may be advanced in turn through automatic sand bag filling system 100 to the filling position as illustrated by bag 151 by any suitable web advancing mechanism or instrumentality. In a preferred embodiment, each bag is advanced to the fill position using return motion of fill hopper assembly 130. For example, in a typical sequence, bag 151 is filled, fill hopper assembly 150 is moved to its raised position (see, for example, FIG. 9), and bag 151 removed. As fill hopper assembly 130 returns from the raised position towards the filling position, terminal end 133 is caused to enter into the opening 154 of the next bag 153. Continued downward motion of fill hopper assembly 130 advances terminal end 133 of fill channel 132 further into bag 153 until terminal end 133 reaches the bottom of bag 153. Further downward motion of fill hopper assembly against the resistance of the bottom of bag 153 causes the entire web 150 to be advanced until both bag 153 and fill hopper assembly 130 are together positioned in the filling position.

Repetition of this sequence advances each of the bags of web 150 through automatic sand bag filling system 100 in a reliable manner without need for complicated control and drive systems to independently position each bag in the filling position. To ensure that terminal end 133 of fill channel 132 is directed into bag opening 154, and each successive bag opening, door 154 has a leading flange member 137. Flange member 137 may be biased towards back plate 122 so that it very closely follows the surface of web 150, itself supported against back plate 122, until it encounters bag opening 154. Biasing door 154 in this manner allows flange member 137 to accommodate irregularities or changes in thickness of web 150 and still reliably engage bag opening 154. Flange member 137 is preferably constructed of a relatively thin material and shaped to easily slip within bag opening 154 during the return stroke of fill hopper assembly 130.

To provide reliable control and delivery of web 150 from its source, typically a palletized stack or roll of continuous bags, automatic sand bag filling apparatus 100 may include one or more tensioning mechanisms adapted to maintain a desired amount of tension in web 150. Preferably, automatic sand bag filling apparatus 100 may include one or more driven rollers adapted to provide a desired level of back tension to web 150 to prevent slack from developing in web 150 which tends to result in poor web control.

In a preferred embodiment, automatic sand bag filling apparatus 100 has tension roller assembly 125 which has a first roller 126 and a second roller 127. First and second rollers 126 and 127 are generally parallel to each other and positioned sufficiently close together to form a nip therebetween. First and second rollers 126 and 127 be mounted in bearings provided on mounting plate 128. At least one of rollers 126 or 127 is connected to motor 129 which may be driven opposite to the direction of web advancement to supply back tension to web 150 routed through the nip between first and second rollers 126 and 127. A rotational encoder (not shown) is preferably associated with motor 129 or one of rollers 126 or 127 to provide feedback as to whether web 150 has advanced as expected as fill hopper assembly 130 is cycled as described above.

The sand to be distributed into each of the bags of web 150 by fill hopper assembly 130 may delivered into filler hopper assembly 130 in a number of ways. For example, sand my be fed directly into top opening 131 of fill hopper assembly 130 using any type of common auger, screw pump, conveyor, or the like suitable to deliver bulk sand. If desired, the sand may be delivered relatively continuously into fill hopper assembly 130 and fill channel 132. In that case, the amount of sand metered into each bag may be determined by controlling the length of time door 134 remains opened as fill hopper assembly 130 is withdrawn from the sand bag to be filled. More preferably, predetermined or premeasured amounts of sand are metered into fill hopper assembly 130 at the desired time intervals to cooperate with the operation of the rest of the apparatus.

In a preferred embodiment, metered volumes of sand are provided as desired by way of a metering device of any suitable construction such as, for example, dump assembly 115. Dump assembly 115 preferably receives sand from an external auger, screw pump, conveyor, or other bulk transfer device in a generally continuous fashion. When a desired amount of sand has been accumulated within dump assembly 115, typically the amount of sand being that which is required to fill a single sand bag to a desired level or weight, dump assembly 115 causes the accumulated sand to be displaced into top opening 131 of fill hopper assembly 130. Fill hopper assembly 130 directs the sand into fill channel 132 where it preferably remains substantially confined until released into the bag as described above.

The sand is input into dump assembly 115 at a location located generally under input cover 105. Preferably, the sand is directed to fill hopper assembly 130 by operation of an articulating sand transfer member which can extend to a position over top opening 131 where a desired amount or charge of sand is released into fill hopper assembly 130. In a preferred embodiment of dump assembly 115, shown best in FIGS. 7–8C, the transfer member is a sliding platform or tray 190 which has a false bottom through which the charge of sand passes by force of gravity into fill hopper assembly 130 after tray 190 has been extended at least partially over top opening 131.

Figure 7:
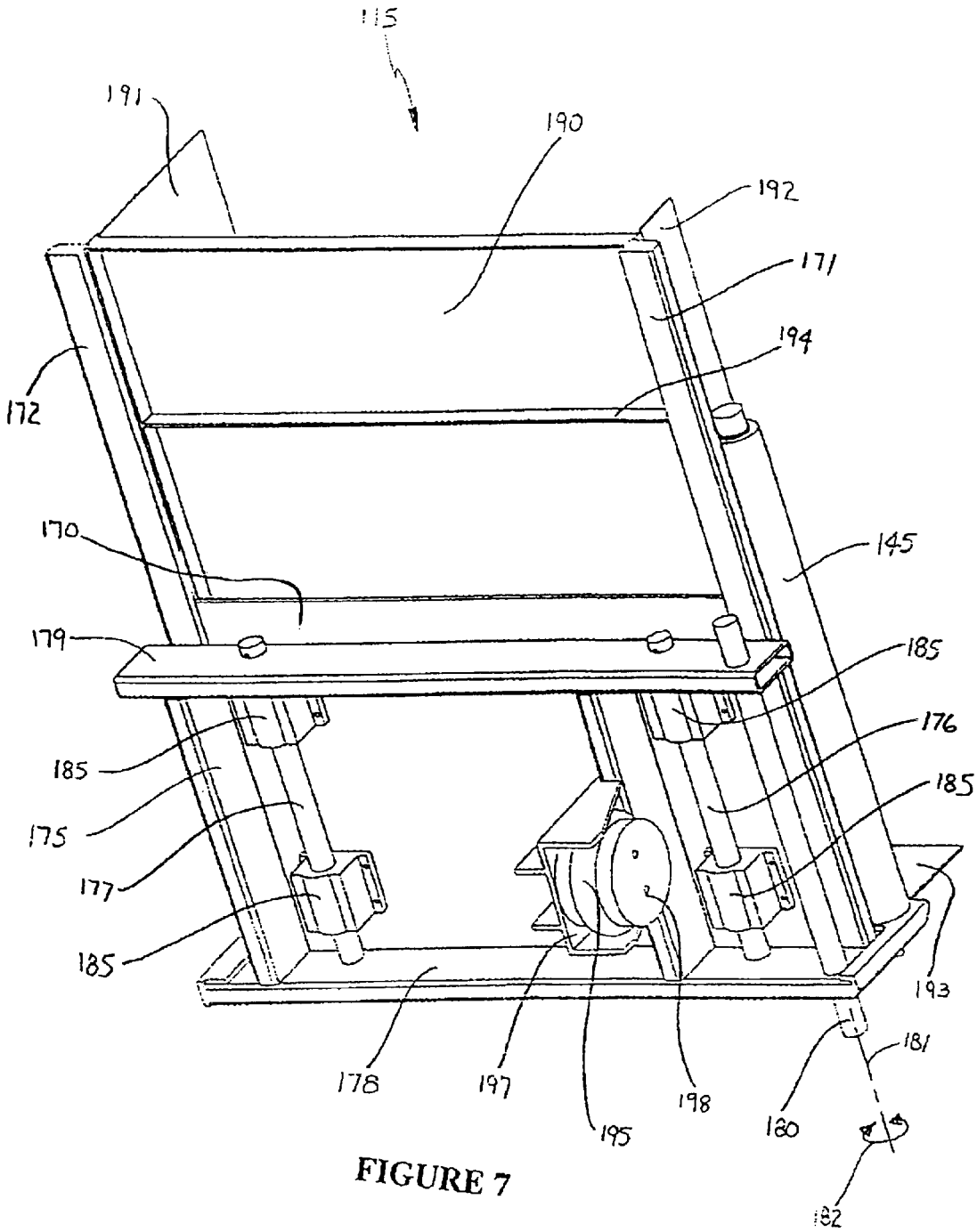
FIG. 7 is a perspective view illustrating a preferred dump assembly constructed according to the principles of the present invention.
Figure 8A:
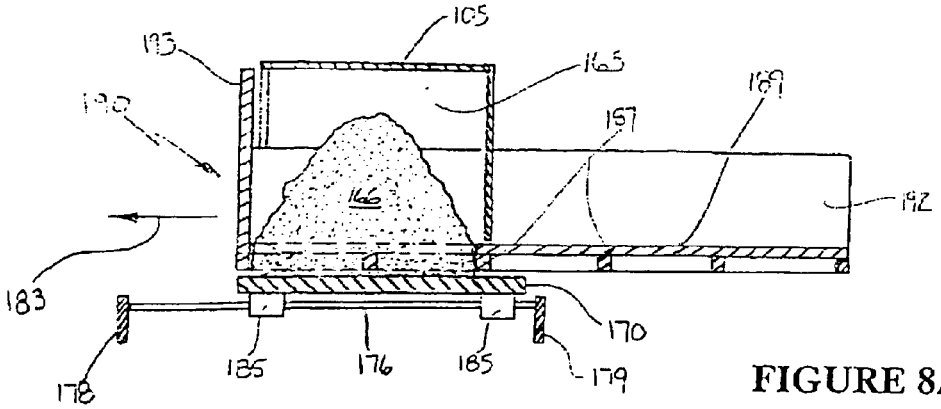
FIGS. 8A, 8B and 8C are cross-sectional side views schematically illustrating operation of the preferred dump assembly in first, second, and third operational positions, respectively.
Figure 8B:
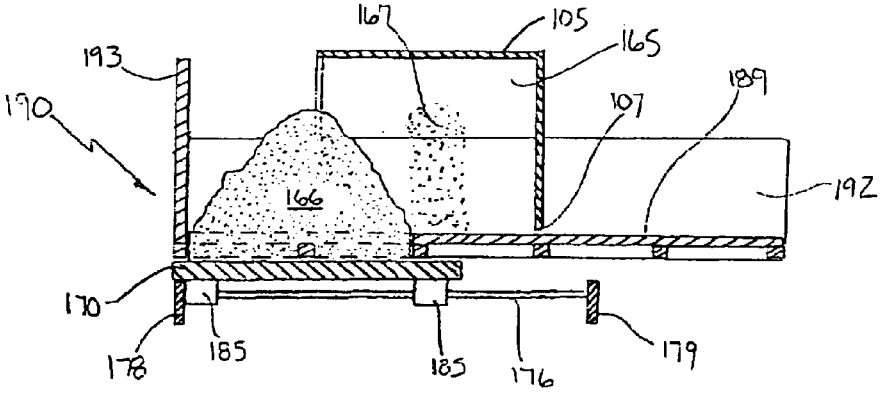
Figure 8C:
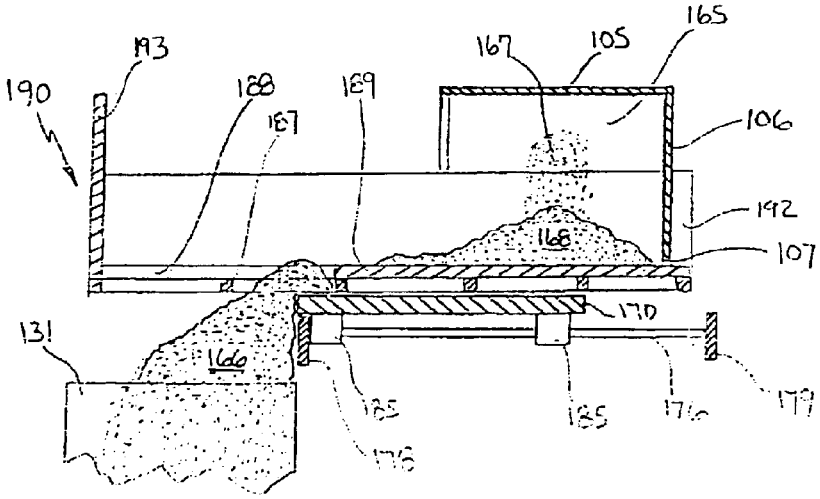

Referring to FIGS. 8A–8C which schematically illustrate the operation of dump assembly 115 of FIG. 7, tray 190 has a bottom panel which generally has a contiguous floor portion 189 and an open portion 188. To keep input sand from spilling, tray 190 may also have front retaining wall 193 and first and second side retaining walls 191. Tray 190 is preferably slidably mounted to allow it to extend over fill hopper assembly 130 when fill hopper assembly is in the fill position, and allows tray 190 to return to a retracted position to allow fill hopper assembly to pass unobstructed to the raised position.

In a preferred embodiment, tray 190 is slidably coupled to bottom plate member 170. Bottom plate member 170 is slidably disposed relative to support members 178 and 179 which may be operably connected to frame 135. Preferably, bottom plate member 170 has linear bearings 185 which slide over first and second bearing shafts 176 and 177. In the retracted position illustrated in FIG. 8A, the input sand, generally entering under input cover 105 and through fill opening 165, falls in the area of the open portion 188 and thus lands on and is supported by the top surface of bottom plate 170. The source of the input sand may be any suitable bulk transfer apparatus such as augers, screw pumps, vacuum delivery devices, conveyors, etc.

When the charge of sand 166 reaches a desired amount, bottom plate 190 and the sand placed thereon along with tray 190 are urged forward in the direction indicated by arrow 183 to an intermediate position as illustrated in FIG. 8B. At that point, the travel of bottom plate 170 is limited, such as by one or more of bearings 185 stopping against support member 178 or in some other suitable manner. At that point, the charge of sand has been at least partially positioned over top opening 131, yet remains supported by bottom plate 170.

With bottom plate 170 restricted from further travel, tray 190 is urged to a fully extended position as shown in FIG. 8C. As tray 190 is extended forward relative to bottom plate 170, the charge of sand the sand is swept off of bottom plate 170 by the relative movement of tray 190 and is caused to be deposited into top opening 131 as shown. In a preferred embodiment, tray 190 has one or more wiper members 187 extending across open portion 188 to ensure substantially all of the charge of sand 166 is removed from bottom plate 170. The articulation of tray 190 between the retracted and extended positions is accomplished by any suitable actuator, preferably by linear air or hydraulic cylinder 145.

As the charge of sand 166 is deposited into top opening 131 by the extension of tray 190 relative to bottom plate 170, input sand 167 may continue to be delivered into tray 190. With the drawer extended, the next charge of sand 168 lands on and is supported by floor 189 of tray 190. When tray 190 is retracted in the direction opposite that indicated by arrow 183, back wall 106 of input cover 105 forces the next charge of sand 168 over the open portion 188 and thus onto bottom plate 170. Preferably back wall 106 has transverse edge 107 positioned very close to floor 189 to ensure substantially all of the sand is displaced onto bottom plate 170.

When tray 190 is fully retracted, and a desired charge of sand has again been accumulated, the sequence just described is repeated. This configuration of tray 190 allows a continuous flow of input sand to be converted to metered charges of sand for delivery to fill hopper assembly 130. This is particularly advantageous as many bulk transfer devices such as augers and the like do not perform reliably under start/stop operating conditions.

The amount of sand contained in each charge of sand delivered into fill hopper assembly 130 may be determined simply by controlling the time between cycles, the bulk flow rate of the input device, or both. In a preferred embodiment, the incremental weight of the charge of sand is monitored as the charge of sand is accumulated. When the weight of the charge of sand reaches a desired value, tray 190 is activated to deliver the charge to fill hopper assembly 130. This allows the bags to be consistently filled to a preselected weight and allows an operator to easily adjust the filling process to account for varying bulk materials, different sand bag capacities or materials, etc. Means for monitoring the weight of accumulated sand may include common scales, force sensors, strain gauges or other suitable weighing device.

Referring to FIG. 7, a weighing device for monitoring the weight of the accumulated charge of sand held by dump assembly 115 may be provided by mounting dump assembly 115 on a pivot and allowing the weight of the dump assembly and accumulated charge bear against a scale, strain gauge, or other suitable sensor which is responsive to the change in weight as the sand is accumulated. In a preferred embodiment, dump assembly 115 has a mounting frame 175 which is pivotally connected to frame 135. Preferably, mounting frame 175 has a pivot shaft 180 extending from support members 178 and 179 which may be mounted within bushings or bearings (not shown) in frame 135. Frame 175 has a rotation stop feature extending therefrom which engages a point or feature (not shown) of frame 135 to limit the rotation of dump assembly 115 about pivot axis 181 as indicated by arrow 182 and cause dump assembly 115 to be held in the roughly horizontal orientation.

A sensor or other suitable device may be disposed between the stop feature and the engagement point or feature on frame 135. The reaction forces between the stop feature and the engagement point on frame 135 necessarily change in proportion to the weight of the accumulated sand. When the force or pressure developed in response to the accumulation of sand upon dump assembly 115 reaches a predetermined value corresponding to a charge of sand having a certain desired weight, tray 190 is activated to transfer the charge to fill hopper assembly 130.

In a preferred embodiment, the charge weight may be monitored or measured using industrial air bladder 195 mounted on bracket 197. Rotation of dump assembly 115 about pivot axis 182 causes the air bladder to be compressed between bracket 197 and frame 135. Air bladder 195 has at least one port 198 by which the internal pressure may be monitored using a conventional pressure gauge. Preferably, the pressure developed in air bladder 195 in response to different weighted charges can be empirically determined for use in providing the user with an instrument gauge and control with which to adjust the charge weight as desired. Even without such calibrated instrumentation, the charge weight may simply be adjusted more or less by having the operator observing the size or weight of the charge delivered by the apparatus and adjusting the tray 190 to discharge at a slightly higher or lower indicated pressure within air bladder 195.

Depending somewhat on the mechanical characteristics of the sand bag material and construction, it may be desirable to control the sand bag as it is filled. In addition, it may be desirable to provide support to the sand bag to allow subsequent cutting or sealing operations to be reliably performed on the filled bag. For these purposes, automatic sand bag filling apparatus 100 preferably has one or more support members that are positioned inside the sand bag prior to filling. Preferably, at least two elongate support members are inserted into each sang bag and then forced apart relative to each other to hold the bag or to apply a certain amount of circumferential tension to the sand bag.

The tension serves to hold the bag in a stable open position and tends to prevent the bag from bulging or collapsing as the bag is filled with the relatively heavy charge of sand.

Automatic sand bag filling system 100 preferably has first and second spreader bars 141 and 142 which may be inserted into each sand bag and spread open to provide a measure of support to the sand bags during filling and subsequent operations. As will be discussed in more detail below, first and second spreader bars 141 and 142 are associated with spreader bar assembly 140 which causes spreader bars 141 and 142 to move together and apart relative to one another in a substantially parallel fashion. Spreader bar assembly 140 is also operably connected to telescopic lift assembly 110 which allows spreader bar assembly 140 to articulate from a first position (as shown, for example, in FIG. 1) to a second, raised position (as shown, for example, in FIG. 16).

Having described the basic operation of the major components, a preferred sequence of operation of the various components of automatic sand bag filling system 100 will now be described in more detail. A supply of interconnected bags, such as provided on web 150, is loaded into the machine and fill hopper assembly 130 and spreader bars 141 and 142 are engaged into the first bag 151 and placed into the filling positions as generally shown in FIG. 3. Spreader bar assembly 140 is activated to spread bars 141 and 142 apart generally against the sides of the bag to provide the desired support or tension to first sand bag 151.

When dump assembly 190 has accumulated the desired charge of sand from bulk input 102, dump assembly 115 is activated, placing tray 190 into its extended position as shown, thus depositing the charge of sand within fill hopper assembly 130 in the manner described at length above. At this instant, the charge of sand remains generally confined with fill channel 132. Referring to FIGS. 4A–6, door 134 at the terminal end 133 of fill channel 132 is opened in preparation for the withdrawal of fill channel 132 from within bag 151. In order to more clearly see the operation of the various components of automatic sand bag filling system 100, the interconnected sand bags of web 150 are not shown in the FIGS. 4A–6, nor the remaining figures to follow.

Figure 9:
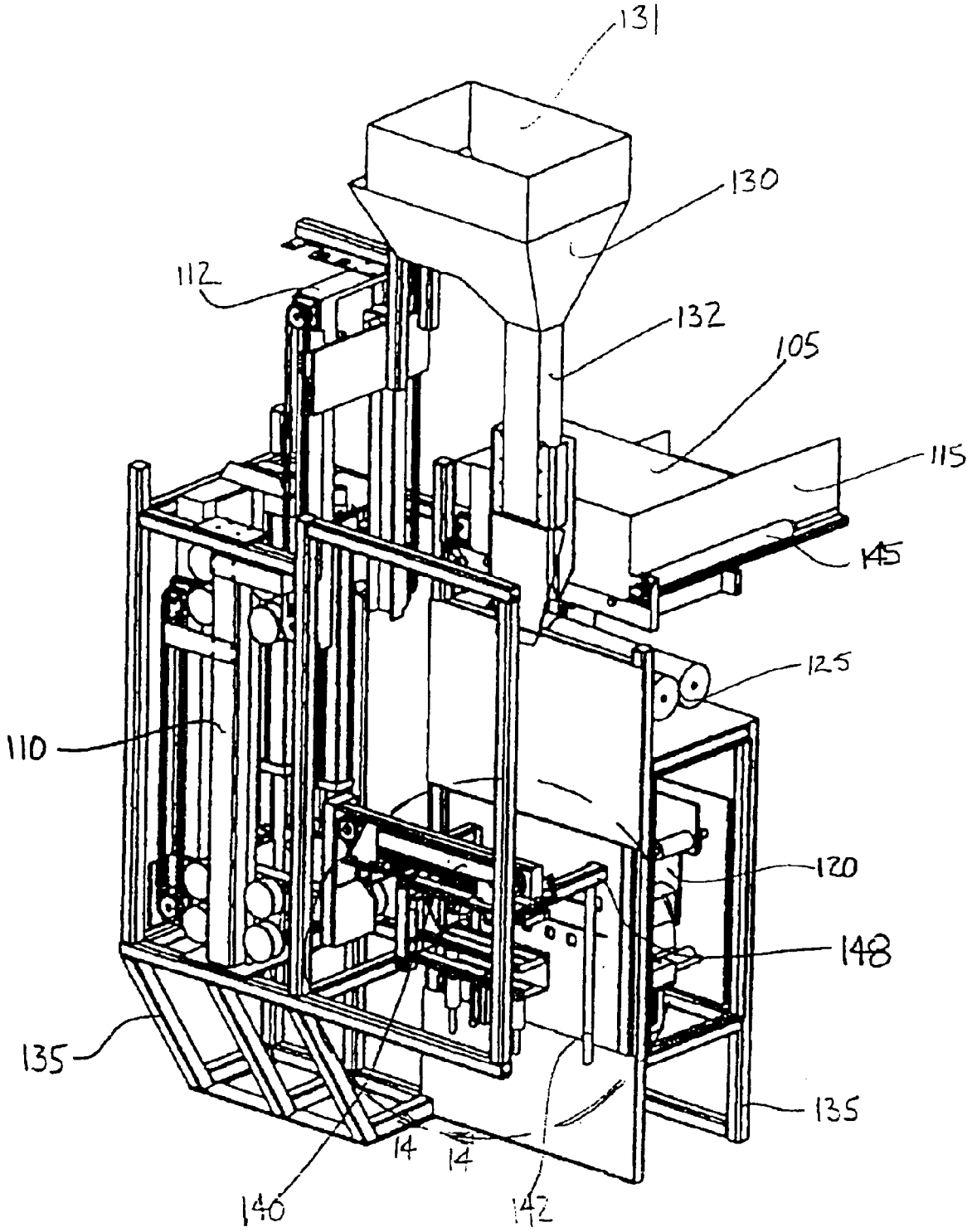
FIGS. 9, 10 and 11 are perspective, front and side views, respectively, illustrating the automatic bag filling apparatus showing an articulated position of the fill hopper assembly.
Figure 10:
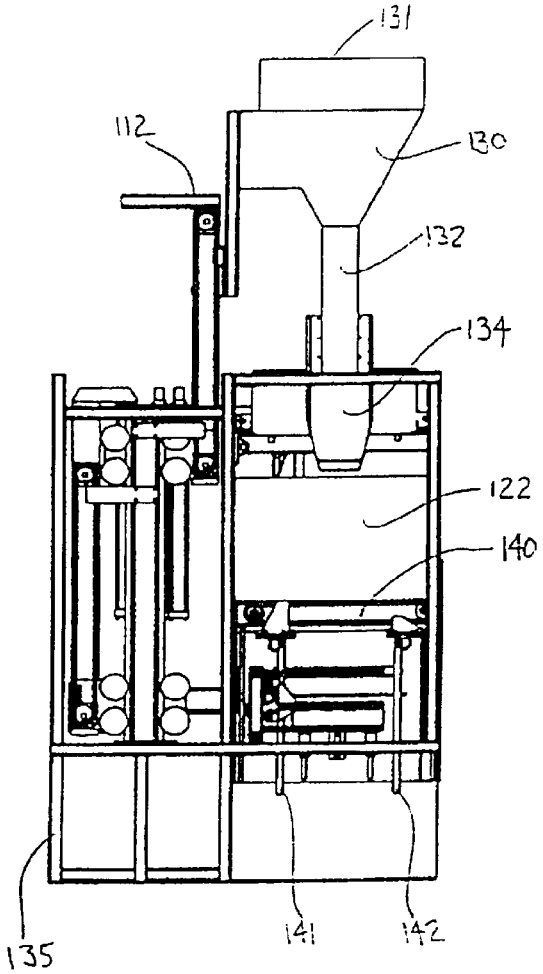
Figure 11:
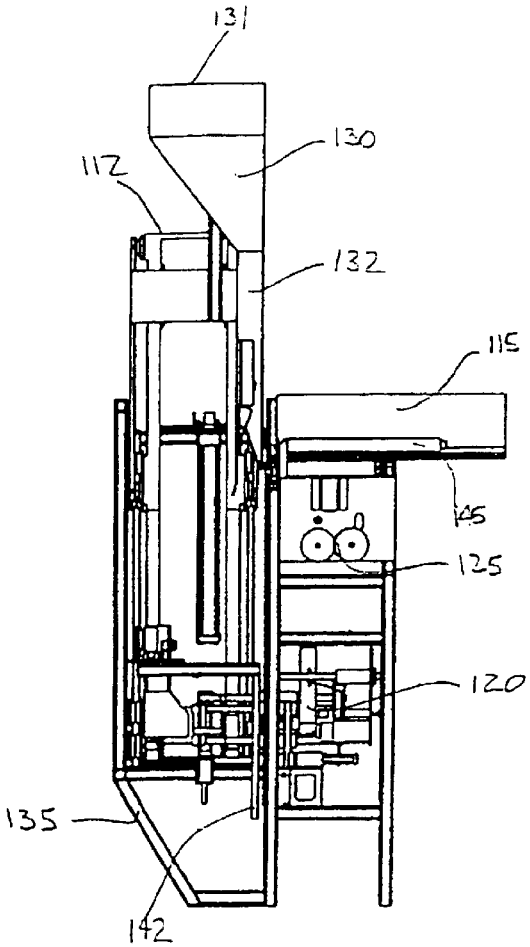

Referring to FIGS. 9–11, dump assembly 115 is then withdrawn to its retracted position where the next charge of sand preferably continues to accumulate. With dump assembly 115 retracted, fill hopper lift assembly 112 of telescopic lift 110 is activated to lift fill hopper assembly 130 to a raised position. As fill conduit 132 is withdrawn from the sand bag, the charge of sand constrained therein is released to fill the sand bag. Once the fill hopper assembly is withdrawn and the sand released, the filled bag is generally supported by spreader bars 141 and 142 and may rest on a platform or conveyor(not shown) under the bag to support the weight of the filled bag. To allow fill hopper assembly 130 to engage the opening of the next sand bag, fill hopper assembly 130 is preferably lifted to a height that places terminal end 133 and door 134 above the opening of the next sand bag.

The fill hopper assembly 130 can be raised and lowered using any convenient mechanism including gear or chain drives, power screws, hydraulic cylinders, or other device capable of controllably raising and lowering the somewhat heavy fill hopper assembly 130 in rapid fashion. To accommodate the relatively long travel of fill hopper assembly 130 and to minimize the overall height of automatic sand bag filling apparatus 100 it is preferred to use a telescoping lift assembly. Preferably, the compound movement of a telescoping lift assembly obtains the desired overall travel of fill hopper assembly 130 using shorter stroke power units thus allowing the mechanism to operate with greater speed. The overall height may be important in circumstances where automatic sand bag filling apparatus 100 is to be mounted on, for example, a truck or trailer that may need to traverse under low bridges, tree branches, or other such obstacles.

Figure 13:
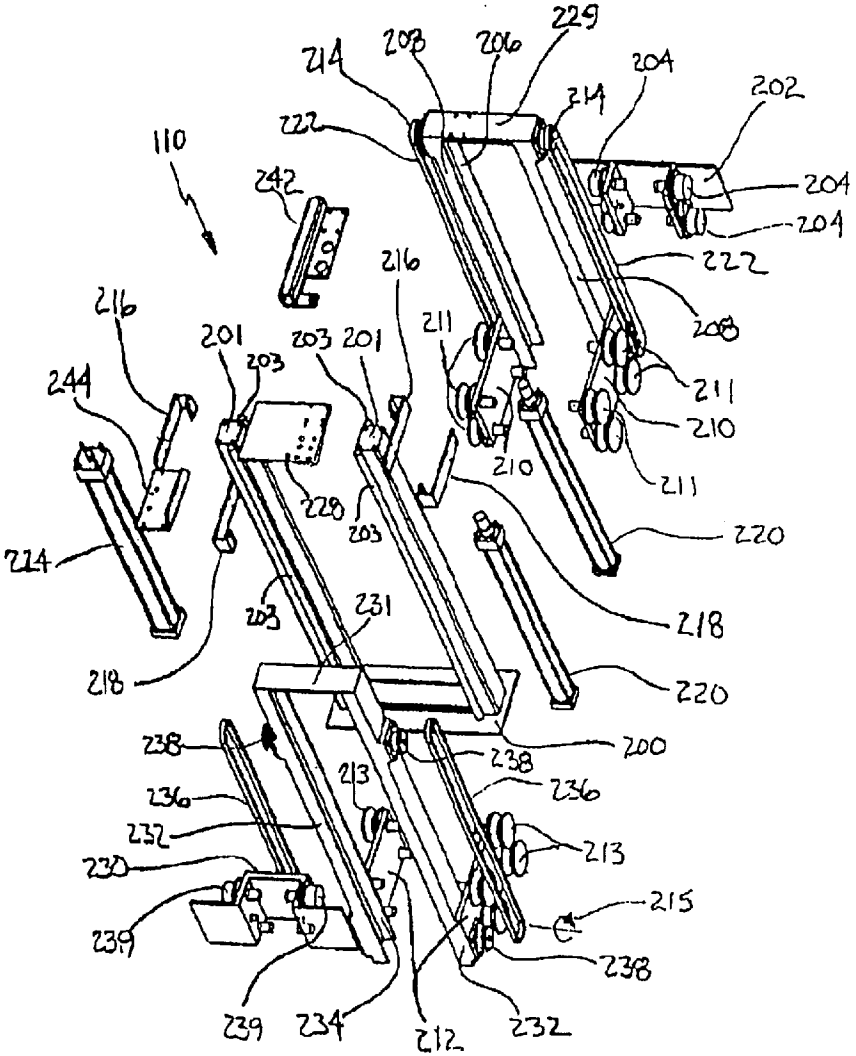
FIG. 13 is an exploded view illustrating the carriage lift assembly of FIG. 12.
Figure 12:
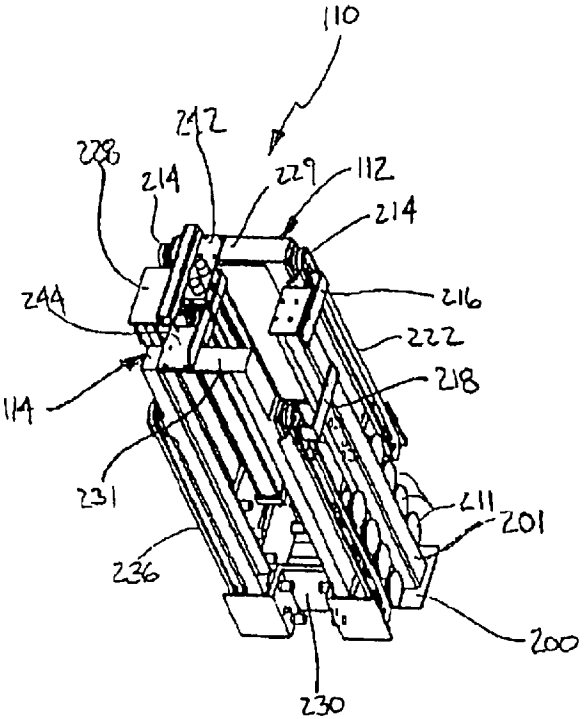
FIG. 12 is a perspective view illustrating a carriage lift assembly constructed according to the principles of the present invention.

A preferred embodiment of telescopic lift assembly 110 is illustrated in FIGS. 12 and 13. Lift assembly 110 preferably includes fill hopper lift assembly 112 and spreader bar lift assembly 114, although separate and unique mechanisms of various types known in the art could be separately used to lift fill hopper assembly 130 and spreader bar assembly 140. As will be described below, each of fill hopper lift assembly 112 and spreader bar lift assembly 114 may be independently raised or lowered preferably under control provided by any suitable force providing actuator including screw drives, linear actuating air or hydraulic cylinders, or other belt, gear, or chain driven motorized mechanisms as are common in the art.

Fill hopper assembly 130 is preferably mounted to fill hopper lift assembly 112 at carriage 202. Carriage 202 is provided with rollers 204 which are received within guide channels 206 of support frame 208. The cooperative engagement of rollers 204 within channels 206 allows carriage 202 to be smoothly driven up and down within support frame 208. Support frame 208 is provided with rollers 211, preferably mounted on support member 210. Rollers 210 are preferably V-type rollers which are cooperatively engaged on rails 203 provided on main vertical supports 201. Of course a number of other alternative arrangements which provide the controlled up and down motion of support frame 208 relative to vertical supports 201 and carriage 202 relative to support frame 208 may be used. Vertical supports 201 may be securely attached and supported by base member 200 which is preferably mounted to frame 135.

Fill hopper lift assembly 112 is raised by operation of one or more fill hopper cylinders 220, which are preferably linear actuating air cylinders. The number of cylinders 220 required depends ultimately on the capacity of the cylinders selected and the forces required to lift fill hopper assembly 130 from the till position to the raised position in the desired amount of time. Cylinders 220 are fixed to cylinder mount plate 228 and act upon fill hopper load plate 242 which is securely coupled to tie plate 229. Thus when cylinders 220 are actuated, load plate 242 and thus support frame 208 is driven upwards as rollers 211 traverse along rails 203.

Carriage 202 is mechanically linked to one side of each drive belt or chain 222 which are supported between pulleys or sprockets 214. The opposite side of each drive chain 222 is secured to vertical supports 201 by way of rigid brackets 216. As support frame 208 is driven upwards relative to the vertical support 201, drive chains 222 are forced to rotate about sprockets 214 in a counterclockwise direction as a result of the fixed connections between drive chains 222 and vertical supports 201. The counterclockwise rotation of drive chains 222 causes carriage 202 to be driven upwards relative to support frame 208 under the controlled movement provided by rollers 204 within guide channels 206. Thus, upon actuation of cylinders 222, support frame 208 is raised along rails 203 and carriage 202 is raised within support frame 208. The combined travel of support frame 208 and carriage 202 provides the necessary travel to lift fill hopper assembly 130 from the filling position to the raised position.

Spreader bar lift assembly 114 operates in substantially the same manner as fill hopper lift assembly 112. Spreader bar assembly 140 mounts to carriage. Carriage 230 is provided with a set of rollers 239 which ride in guide channels 234 provided in support frame 232. Support frame 232 is provided with support plates 212 having V-type rollers 213 mounted thereon which cooperatively engage rails 203 provided on vertical supports 201. Thus support frame 232 moves up and down relative to vertical supports 201 in a constrained manner defined by rails 203 and rollers 213 and carriage 230 moves relative to support frame 232 in a constrained manner defined by guide channels 234 and rollers 239.

Spreader bar lift assembly 114 is raised by operation of air or hydraulic cylinder 224 which is caused to act on load plate 244 connected to tie plate 231. When cylinder 224 is actuated, load plate 242 is driven by cylinder 224 to raise support frame 232 in a controlled fashion as rollers 213 traverse along rails 203. At the same time carriage 230 is coupled to one side of drive chains 236 which is supported between sprockets 238 on support frame 232. The opposite sides of each drive chain 236 is secured to vertical support s201 by brackets 218. As support frame 232 is driven upwards relative to vertical support 201, drive chains 236 are forced to rotate in a clockwise direction as indicated by arrow 215 due to the fixed connection between drive chains 236 and vertical supports 201. The rotation of drive chains 236 causes carriage 230 to be driven upwards relative to support frame 232 under the controlled movement of rollers 239 within guide channels 234.

As mentioned above, once fill channel 132 has been withdrawn from the sand bag to release the charge of sand, spreader bars 240 and 241 remains inside the sand bag to provide support for subsequent operations which, for example, may include cutting the filled bag from the adjacent bag of web 150, sealing the top opening of the sand bag, etc. In a preferred embodiment, spreader bars 141 and 142 support the filled sand bag until engaged by either or both of the bag cutter or bag sealer mechanisms. The support provided by spreader bars 141 and 142 are particularly necessary when certain elements of the bag cutter apparatus and the bag sealer apparatus are engaged from the front of the machine, and accordingly cannot be actuated until fill channel 132 has been moved out of the way.

Figure 14:
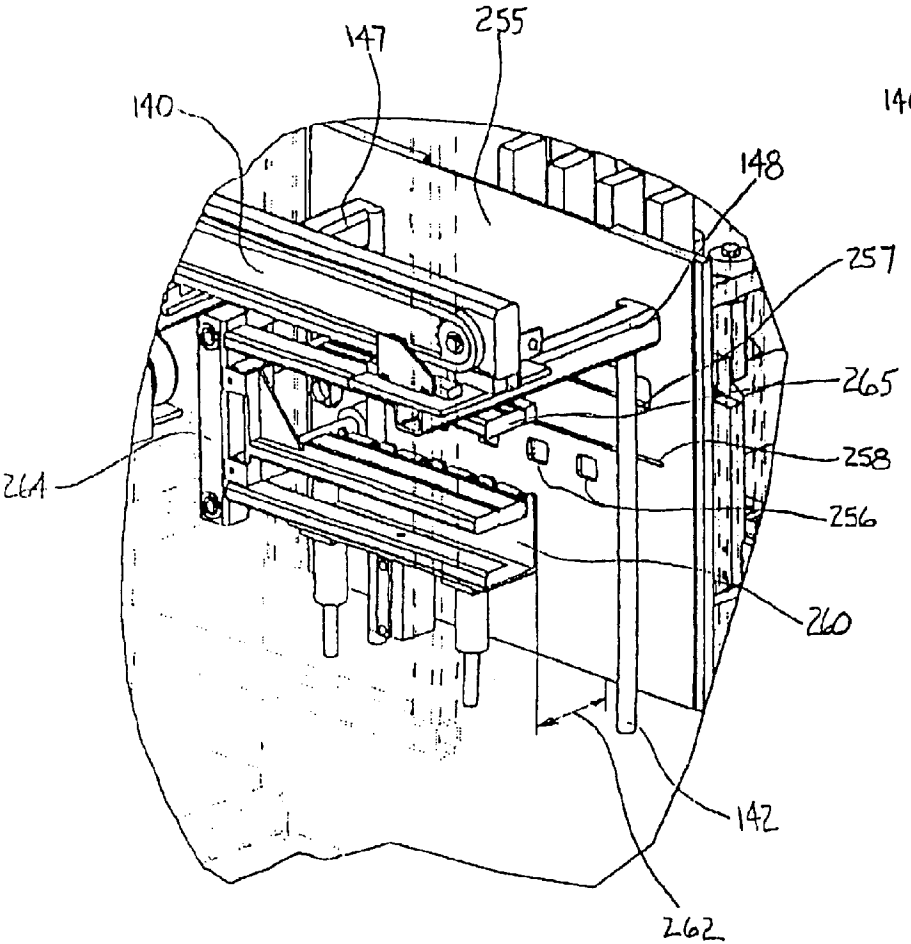
FIG. 14 is a detail view of the area of the automatic filling apparatus generally indicated by line 14—14 in FIG. 9.

Referring to FIG. 14, prior to withdrawal of spreader bars 141 and 142 to allow the filled bag to be severed and sealed it is desirable to pinch or compress the top of the filled bag so that it may be reliably controlled during the cutting and sealing operations. Preferably, one or more clamping elements may be urged against the top of the filled bag in one or more locations to clamp the bag between the clamping elements and back plate 255. In a preferred embodiment, pinch bar 255 is provided to clamp near the location where the bag will be severed or cut and pinch plate 260 is provided to clamp in the vicinity where the bag will be sealed or closed shut.

Figure 15:
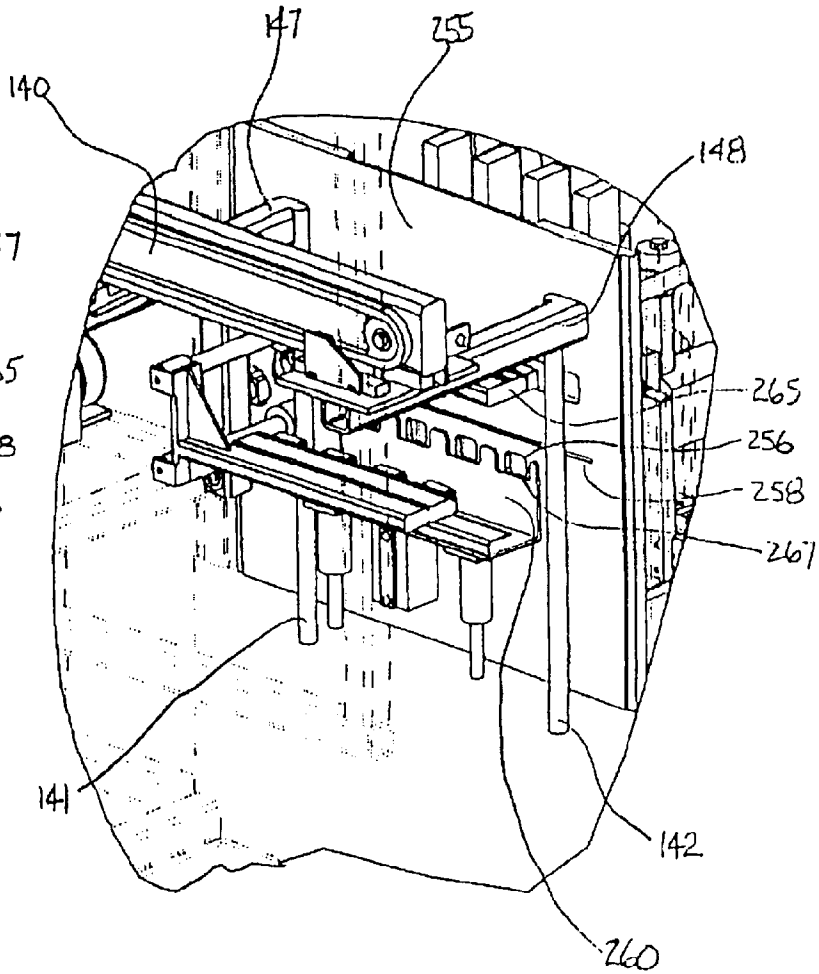
FIG. 15 is a detail view of the area of FIG. 14, illustrating an actuated position of the clamping assembly.
Figure 16:
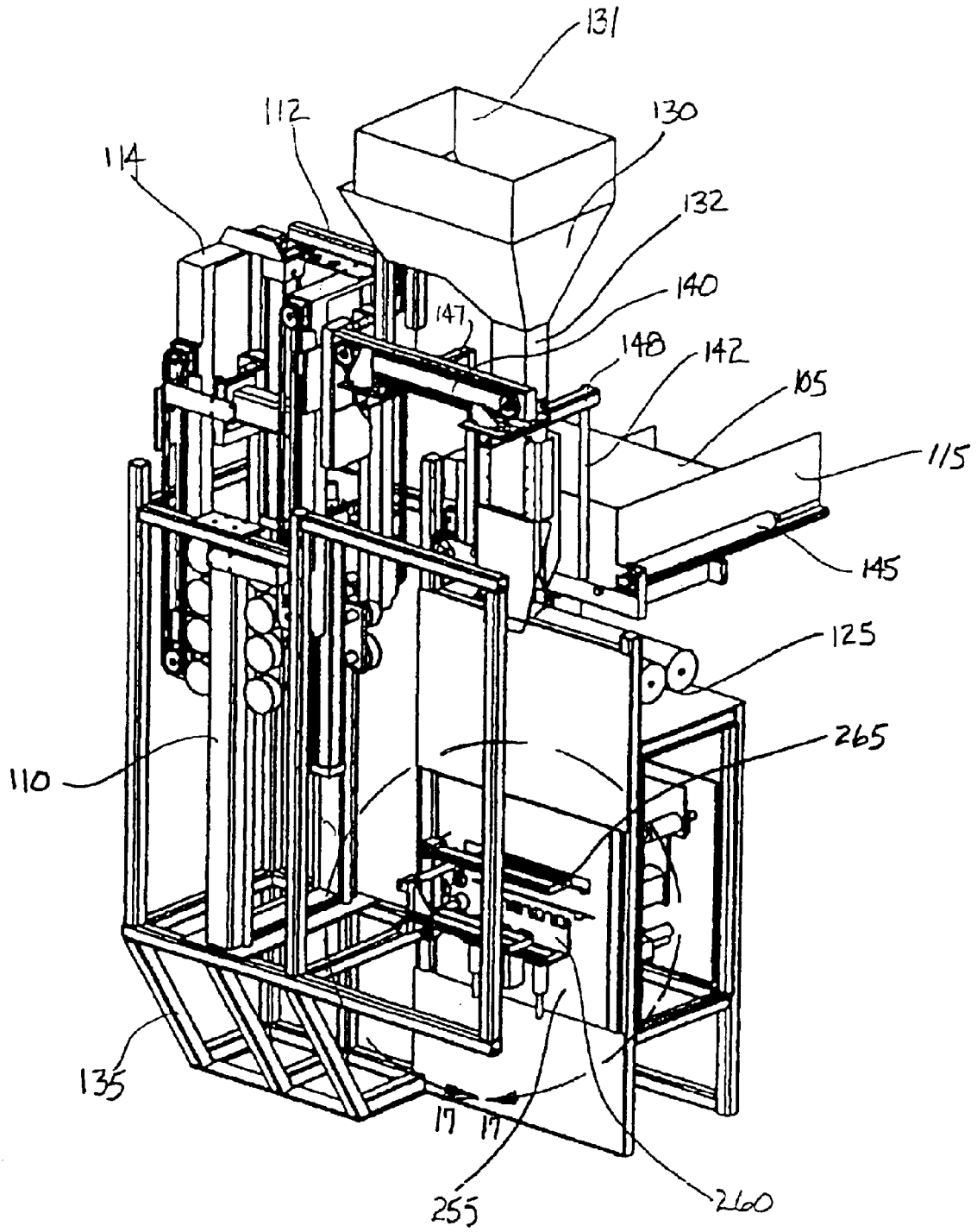
FIG. 16 is a perspective view illustrating the automatic bag filling apparatus showing an articulated position of spreader bar assembly.

Pinch bar 265 and pinch plate 260 are preferably mounted on articulating frame member 264 which moves pinch bar 265 from a position spaced away from back plate 255 by distance 262 to a clamped position against back plate 255 as shown in FIG. 15. When pinch bar 265 and pinch plate 260 are urged against back plate 255, a top portion of the filled sand bag become secured trapped between back plate 255 and pinch plate 260 and pinch bar 265. With the filled bag securely constrained in this manner, spreader bars 141 and 142 are withdrawn by causing spreader bar lift assembly 114 to lift spreader bar assembly 140 to a raised position as shown in FIG. 16.

Figure 17:
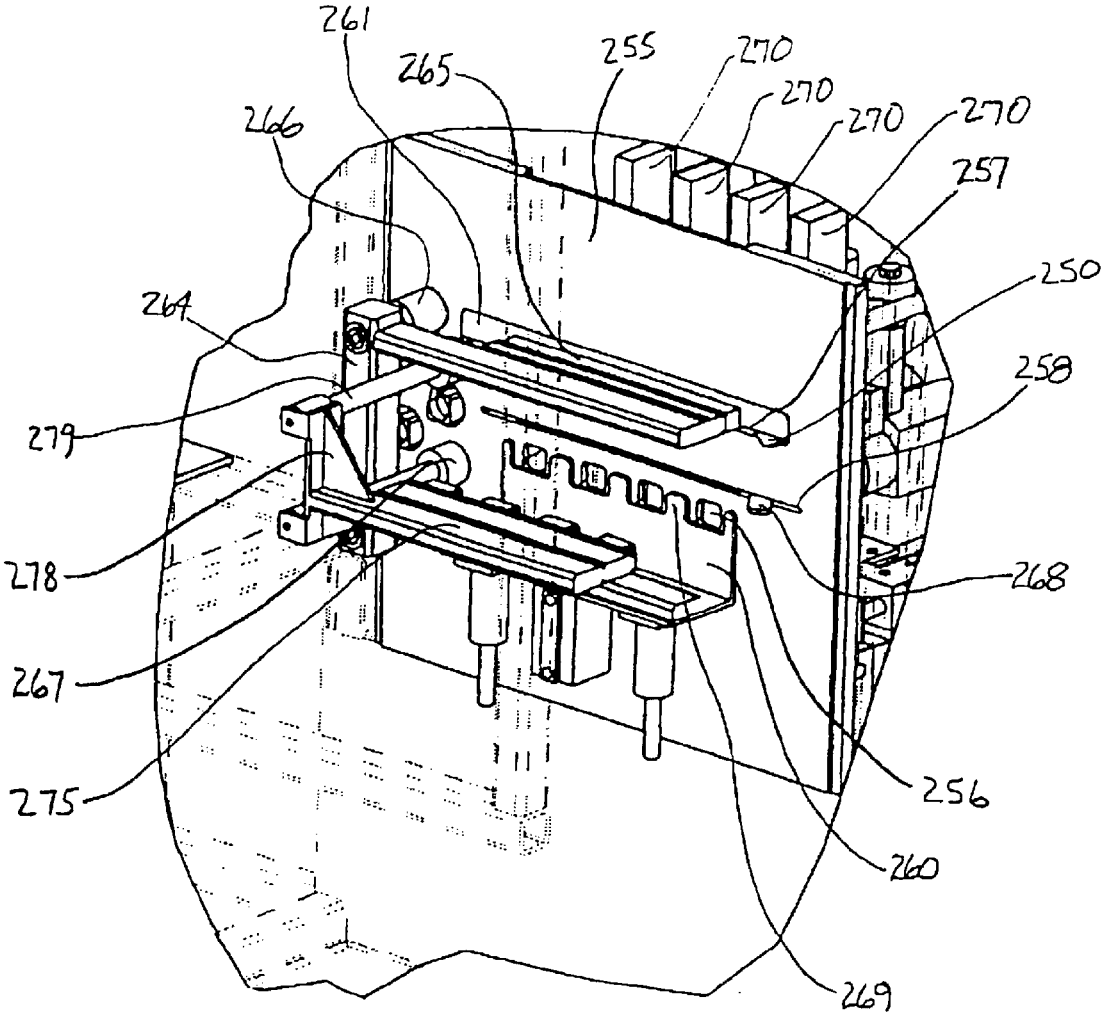
FIG. 17 is a detail view of the area of the automatic filling apparatus generally indicated by line 17—17 in FIG. 16.
Figure 18B:
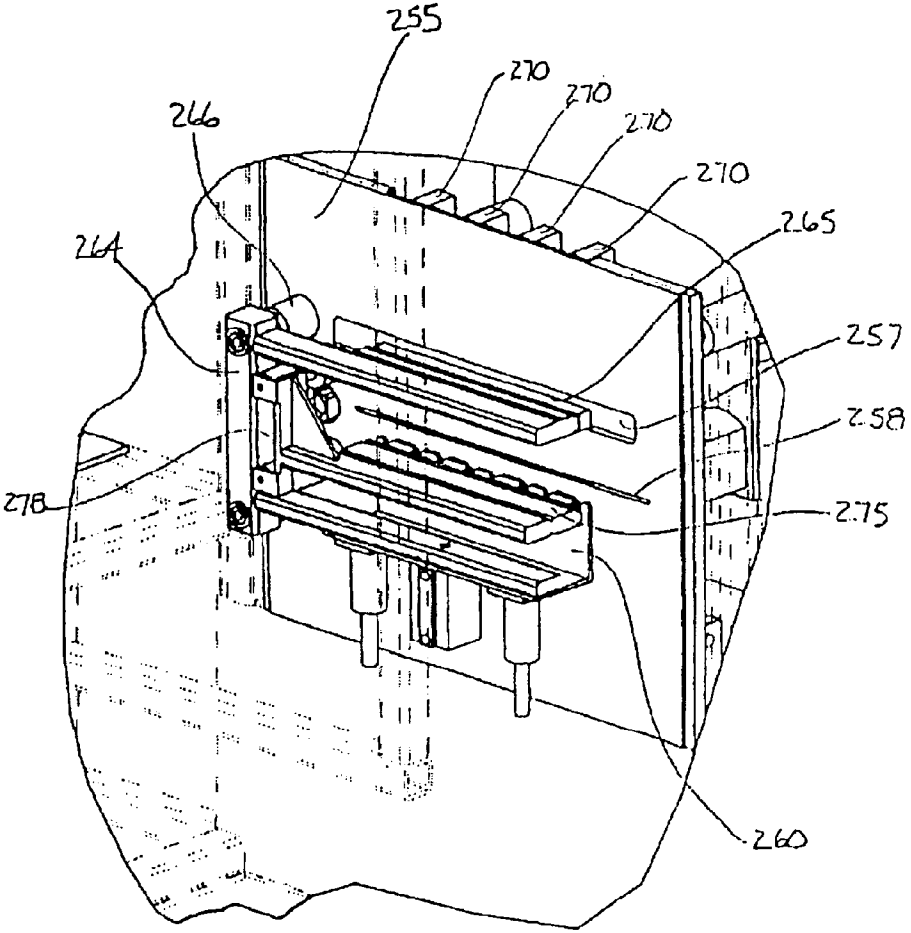
FIG. 18B is a detail view of the area of the automatic filling apparatus generally indicated by line 18B—18B in FIG. 18A showing an actuated position of the stapler assembly.
Figure 18A:
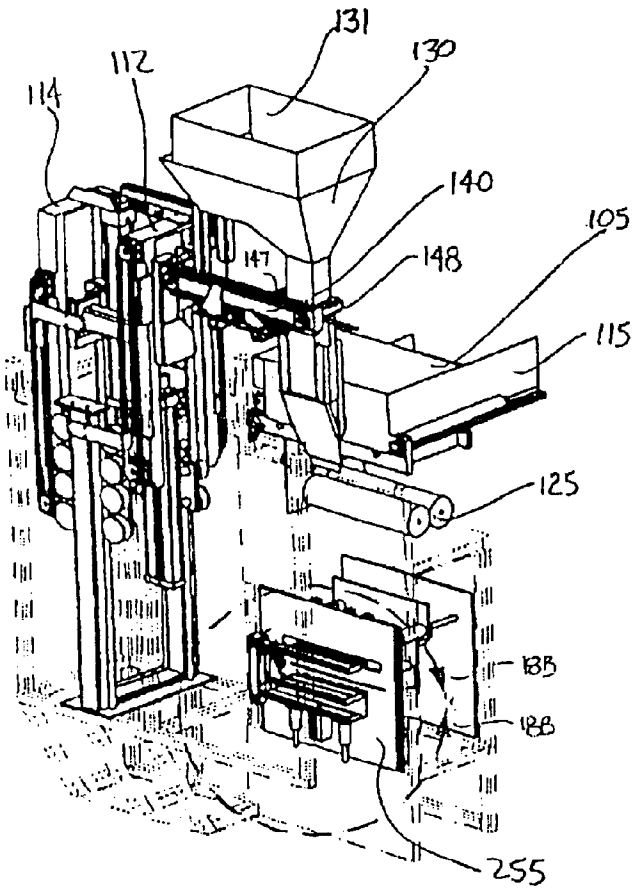
FIG. 18A is a perspective view illustrating the automatic bag filling apparatus showing a retracted position of the spreader bars.

Pinch bar 265 and pinch plate 260 are shown in more detail in FIG. 17 which shows the apparatus after spreader bar assembly 140 has been actuated to the raised position. Articulating arm 264 is preferably mounted on rods 281 (see FIG. 19) which slide within linear bearings 266 mounted on back plate 255. Pinch bar 265 preferably engages the sand bag adjacent cutter guide slot 257. A landing pad 261 of resilient material may be provided on back plate 255 for pinch bar 265. Pinch plate 260 is preferably urged against back plate 255 in the area of cutouts 256 which are sized and positioned to provide access for closing or sealing mechanisms such as stitchers, heat sealers, staplers, etc. In a preferred embodiment, pinch plate 260 may have upwardly extending fingers to provide clamping on both sides of each cutout 256.

With the bag clamped between pinch bar 265 and pad 261, cutter blade 250 is able to easily and reliably cut the filled sand bag from web 150 by traversing across cutter guide slot 257. After the filled bag has been severed from the adjacent bag, the top opening is preferably closed.

In a preferred embodiment, the bag is stapled shut by a series of automatic staplers 270. Staplers 270 access the bag material through cutouts 256. Stapler die plate assembly 275 is preferably mounted on articulating arm 278 so that it may be urged against staplers 270 so that the staples delivered by staplers 270 are formed into the proper closed configuration. Articulating arm 278 is mounted on rods 279 which are slidable within linear bushings or bearings 267 provided in back plate 255. Staplers 270 and die plate assembly 275 are shown in their engaged position in FIGS. 18A and 18B.

Figure 20:
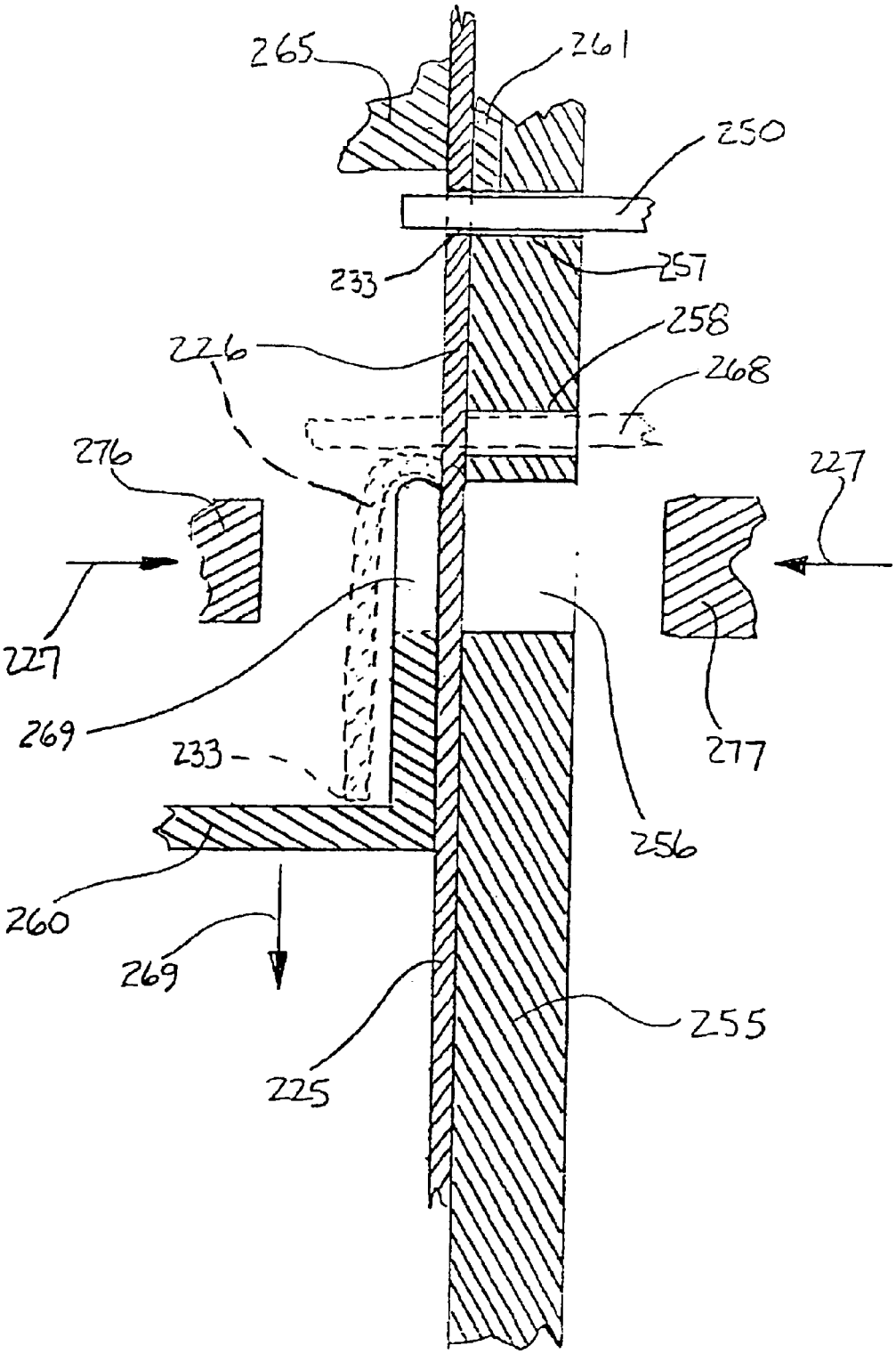
FIG. 20 is a cross-sectional view schematically illustrating the clamping, stapling, and cutting operations.

A preferred cutting and closing sequence is schematically illustrated in FIG. 20. With the multiple layers of bag material 225 securely clamped between back plate 255 and pinch bar 265 and pinch plate 260, cutter blade 250 is extended through guide slot 257 and traversed across guide slot 257 to sever bag material 225 creating severed edge 233. The resulting flap 226 of bag material below severed edge 233 is preferably folded over pinch plate 260 by operation of a kicker bar 268 which extends through and traverses across guide slot 258 to fold flap 226 over pinch plate 260 as shown in phantom lines. Once flap 226 has been folded over, staple dies 276 and staple heads 227 are urged together in the direction indicated by arrows 227 to staple shut the folded bag closure thus providing a strong and durable closure for the filled sand bag. Once the bag has been stapled shut, pinch plate 260 is preferably moved in the direction indicted by arrow 269 to withdraw pinch plate 260 from the stapled closure.

Figure 19:
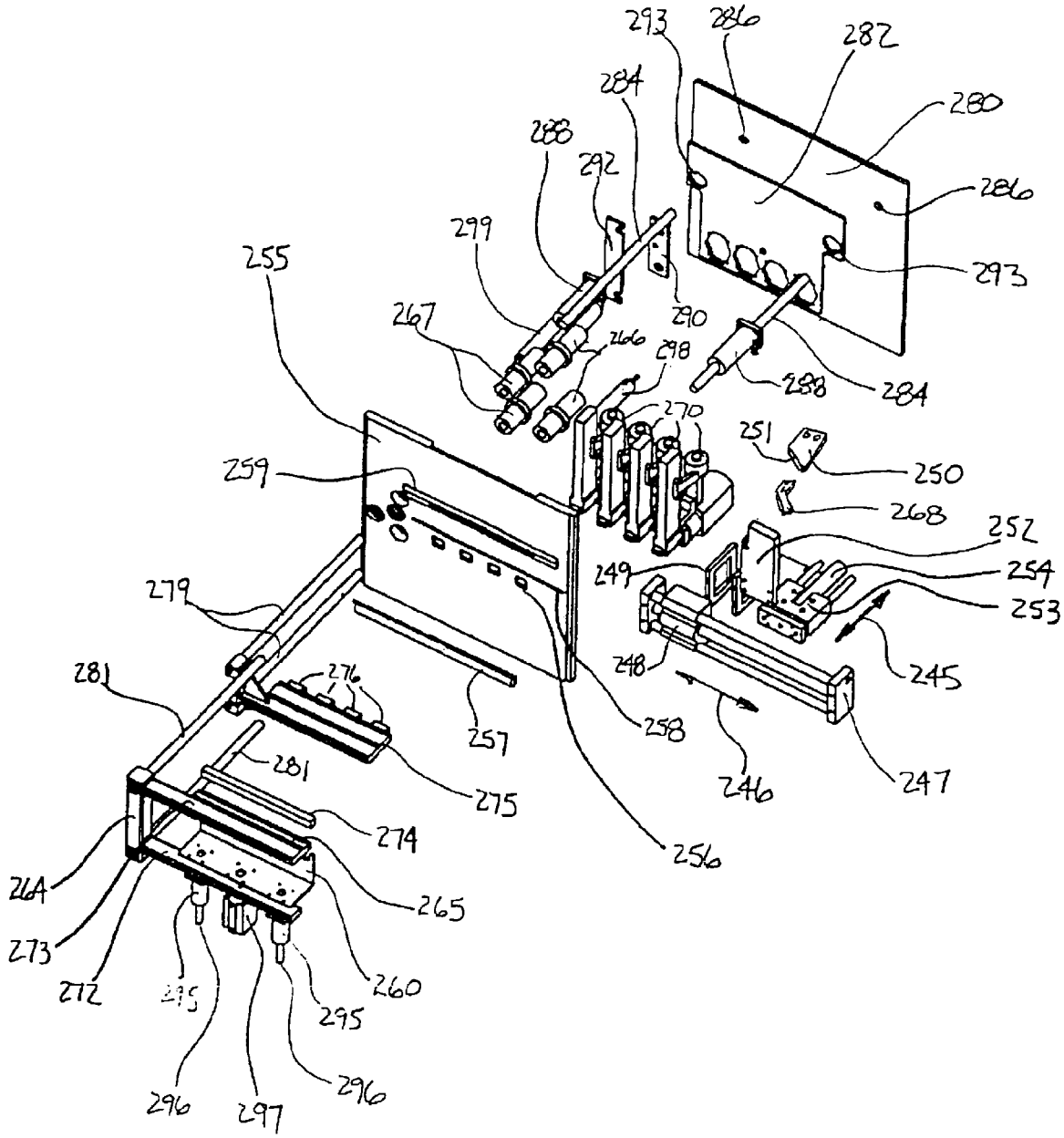
FIG. 19 is an exploded perspective view illustrating a stapler assembly constructed according to the principles of the present invention.

A preferred cutting and closing assembly is illustrated in FIG. 19. Pinch plate 260 and pinch bar 265 are preferably mounted on first and second support arms 272 and 272, respectively, which are attached to articulating frame member 264. Pinch plate 260 is preferably moveably coupled to support arm 272. Preferably, pinch plate 260 is mounted on guide rails 296 which are received within linear bushings or bearings 295. Pinch plate 260 is moved generally up and down relative to support arm 272 by air or hydraulic cylinder 297. Articulating frame member 264 has rails 281 which are slidably received within linear bushings or bearings 266 mounted on back plate 255. To urge pinch plate 260 and pinch bar 265 against backplate 255, air or hydraulic cylinder 299 applies a force to drive plate 292 which is coupled to rails 281, preferably near their free ends. Pinch bar 265 may optionally have a resilient member 274 mounted thereon to more securely engage material of the filled sand bag.

Although a variety of closure or sealing means may used to effectuate closure of the filled sand bags, the sand bags are preferably closed using staplers 270 of common construction. In a preferred embodiment, staplers 270 are mounted on a stapler mount plate or carriage 282. Carriage 282 has linear bushings or bearings 288 mounted in through holes 293. Carriage 282 is slidably supported on cylindrical rails 284 which are which are mounted between back plate 255 and rear frame member 280, for example at rail mount holes 286. Carriage 282 and staplers 270 may are urged towards back plate 255 by air or hydraulic cylinder 298 mounted on Carriage 282 which acts against rear frame member 280.

Die plate assembly 275, preferably having a plurality of die plates corresponding to the number of staplers 270, is also moveably mounted relative to back plate 255. Preferably, articulating frame member 278 is mounted to rails 279 which are slidably received through linear bushings or bearings 267 mounted on back plate 255. The free ends of rails 279 are preferably attached to drive plate 290 upon which an actuating cylinder (not shown) may apply the necessary force to urge die plate assembly 275 towards back plate 255. The staplers 270 and die plates 276 preferably are brought into cooperative engagement (with the bag material to be stapled disposed therebetween) through cutouts 256.

The cutter for severing the filled bag from the adjacent bag and the kicker bar which helps ensure the resulting bag flap is properly positioned for stapling are preferably mounted on traversing carriage 248 which travels back and forth on a rodless cylinder assembly 247 in the direction generally indicated by arrow 246. Preferably, cutter blade 250 having a cutting edge 251 and kicker bar 268 are mounted to move in and out in the direction indicated by arrow 245 so that they be extended out through back plate 255 during cutting operations and then withdrawn until the next cut is required.

In a preferred embodiment, cutter blade 250 and kicker bar 268 are mounted on mount plate 252 which is coupled to carriage 253 which slides freely in the direction indicated by arrow 245 and may be selectively moved by actuating air or hydraulic cylinder 254. The carriage assembly is mounted to traversing carriage 248 by way of adapter brackets 249. Rodless cylinder assembly 247, with traversing carriage 248, is secured to back plate 255. Cutter 250, which is preferably made from a hardened steel such as AISI Series 440C stainless steel, preferably rides across cutter guide 257 mounted within receiving slot 259. Cutter guide 257 is also preferably made from a hardened steel or other like wear material to prevent excessive wear as cutting edge 251 traverses back and forth across cutter guide 257 during cutting operations. Kicker bar 268 extends through and is guided by guide slot 258 in back plate 255.

Figure 21:
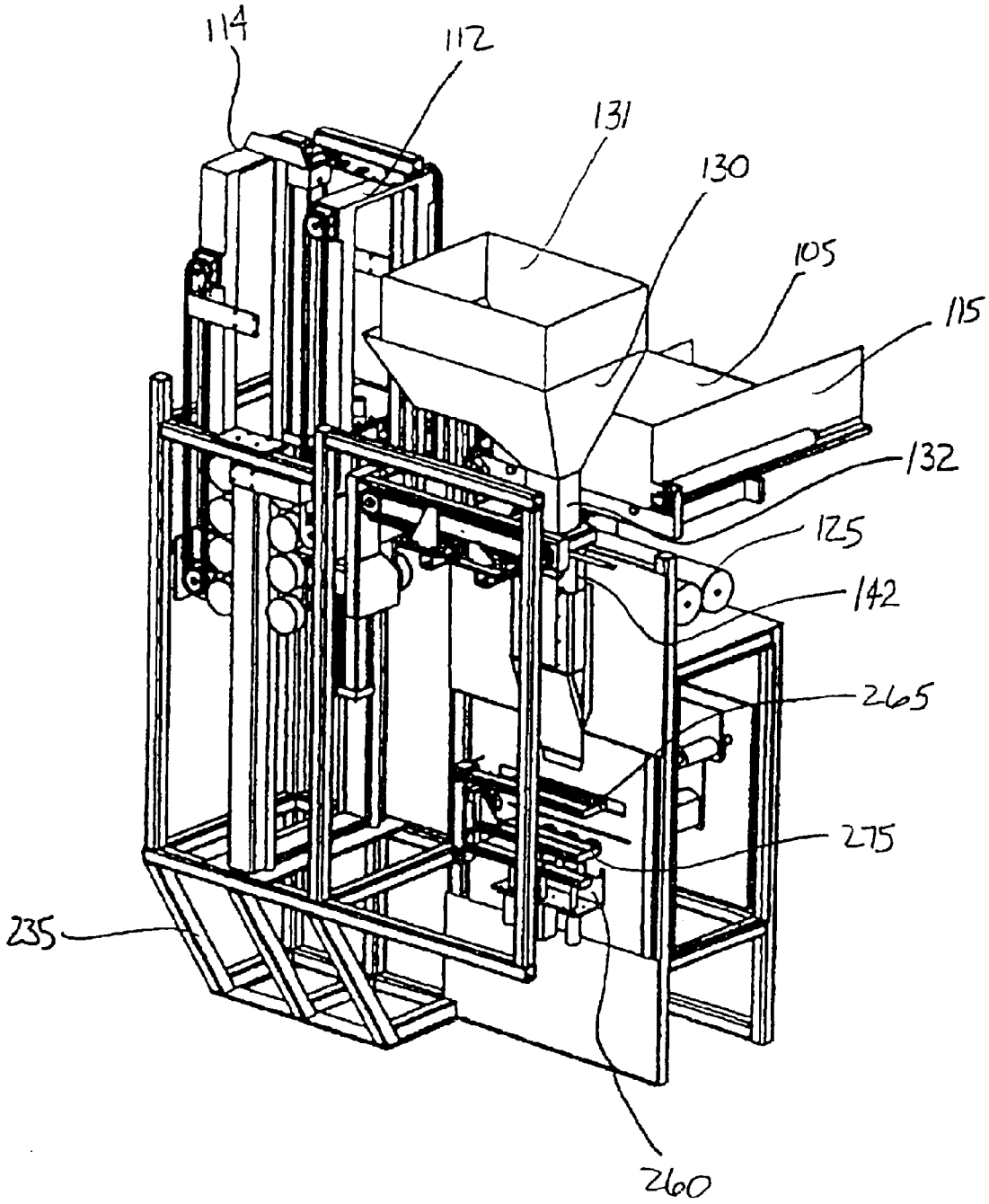
FIG. 21 is a perspective view illustrating the automatic bag filling apparatus showing the fill hopper and spreader bar assemblies being lowered towards the fill position.

During the cutting and closing operations just described, the various components of automatic sand bagging system 100 continue with their respective function. Referring to FIG. 21, a new charge of sand continues to accumulate within dump assembly 115. At the same time, spreader bars 141 and 142 are retracted inwards towards fill channel 132 and both fill channel 132 and spreader bars 141 and 142 begin engage the next bag to be filled as telescoping lift assemblies 112 and 114 begin to lower fill hopper assembly 130 and spreader bar assembly 140, respectively.

Figure 22:
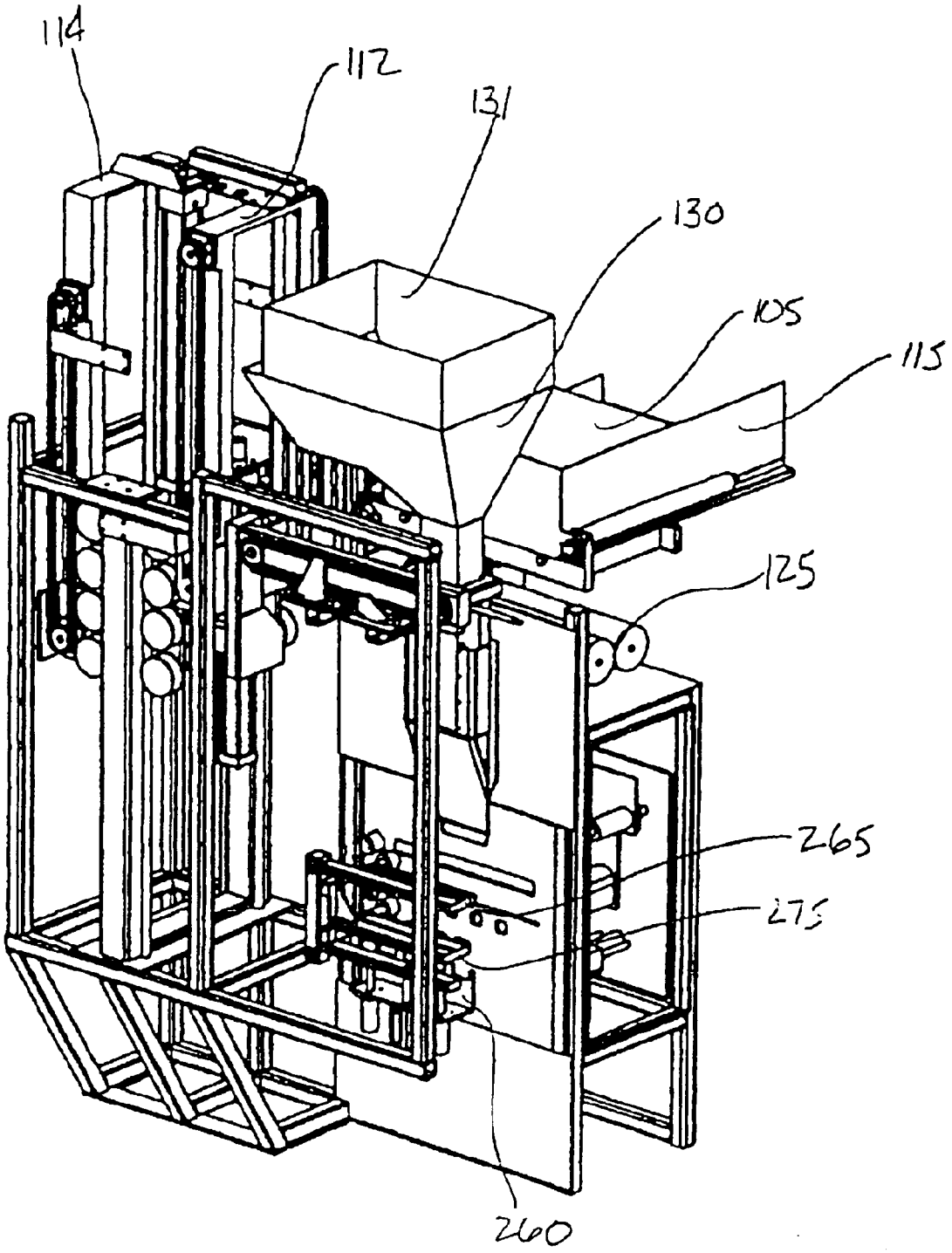
FIG. 22 is a perspective view illustrating the automatic bag filling apparatus showing the clamp assembly and stapler assembly returning from their respective actuated positions.

Fill hopper assembly 130 and spreader bar assembly 140 are preferably not allowed to proceed to the fill position until pinch plate 260, pinch bar 265, and die plate assembly 275 are retracted to a position sufficiently spaced from back plate 255 to allow fill hopper assembly 130 and spreader bar assembly 140 to pass without interference. Upon retraction of those assemblies, as shown in FIG. 22, the filled and closed sand bag is removed from the fill area by gravity, conveyor, or other mechanism designed to carry away the filled sandbags.

Figure 23:
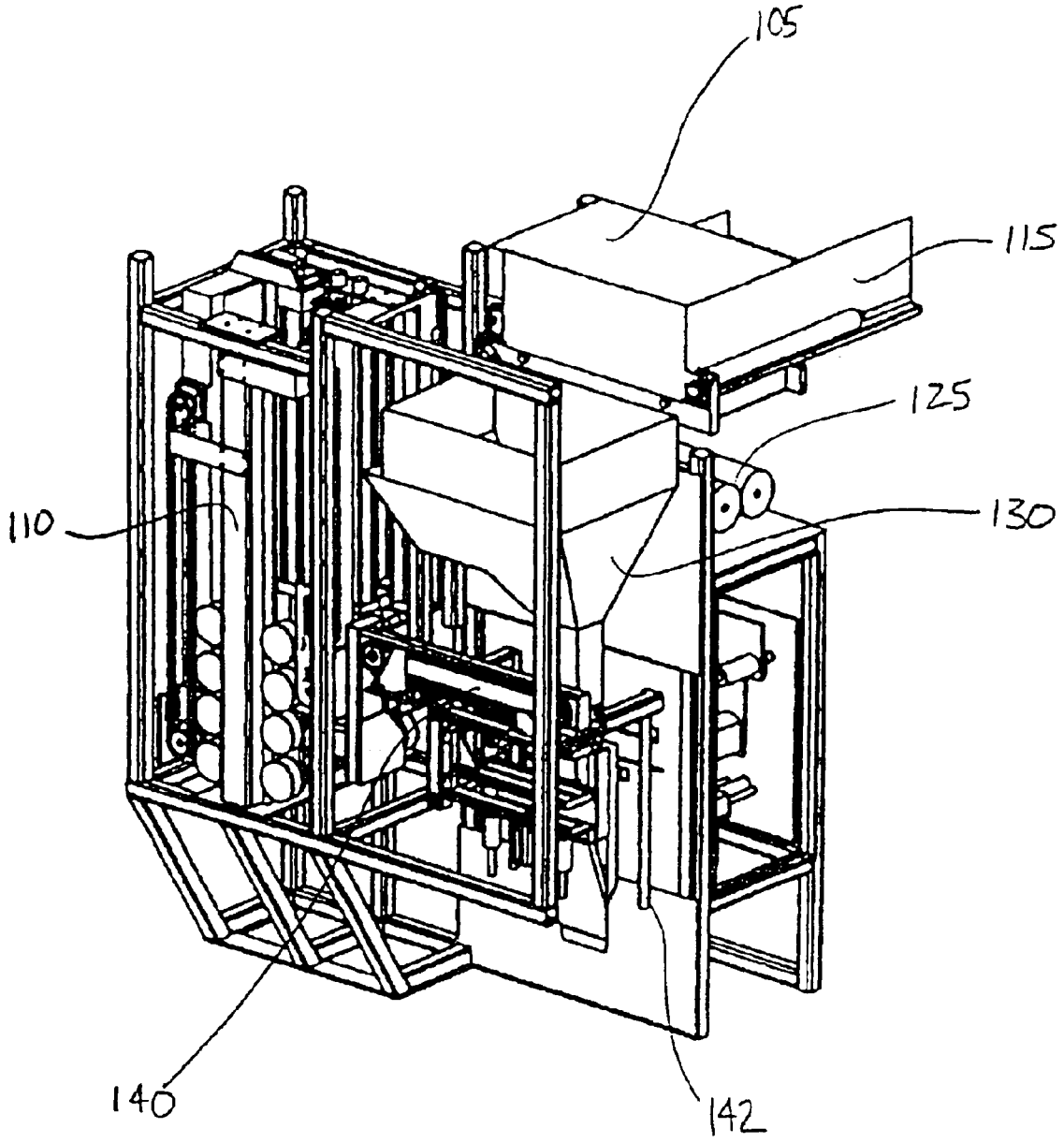
FIG. 23 is a perspective view illustrating the automatic bag filling apparatus in the fill position just prior to actuation of the dump assembly.

Referring to FIG. 23, fill hopper assembly 130, at this point engaged within the interior of the next bag to be filled, may be lowered to the fill position and spreader bars 141 and 142 forced outward to support and tension the sand bag to be filled with sand. Automatic sand bag filling system 100 is now in position to accept a charge of sand from dump assembly 115 to begin the operating sequence as set forth in the above.

Figure 24:
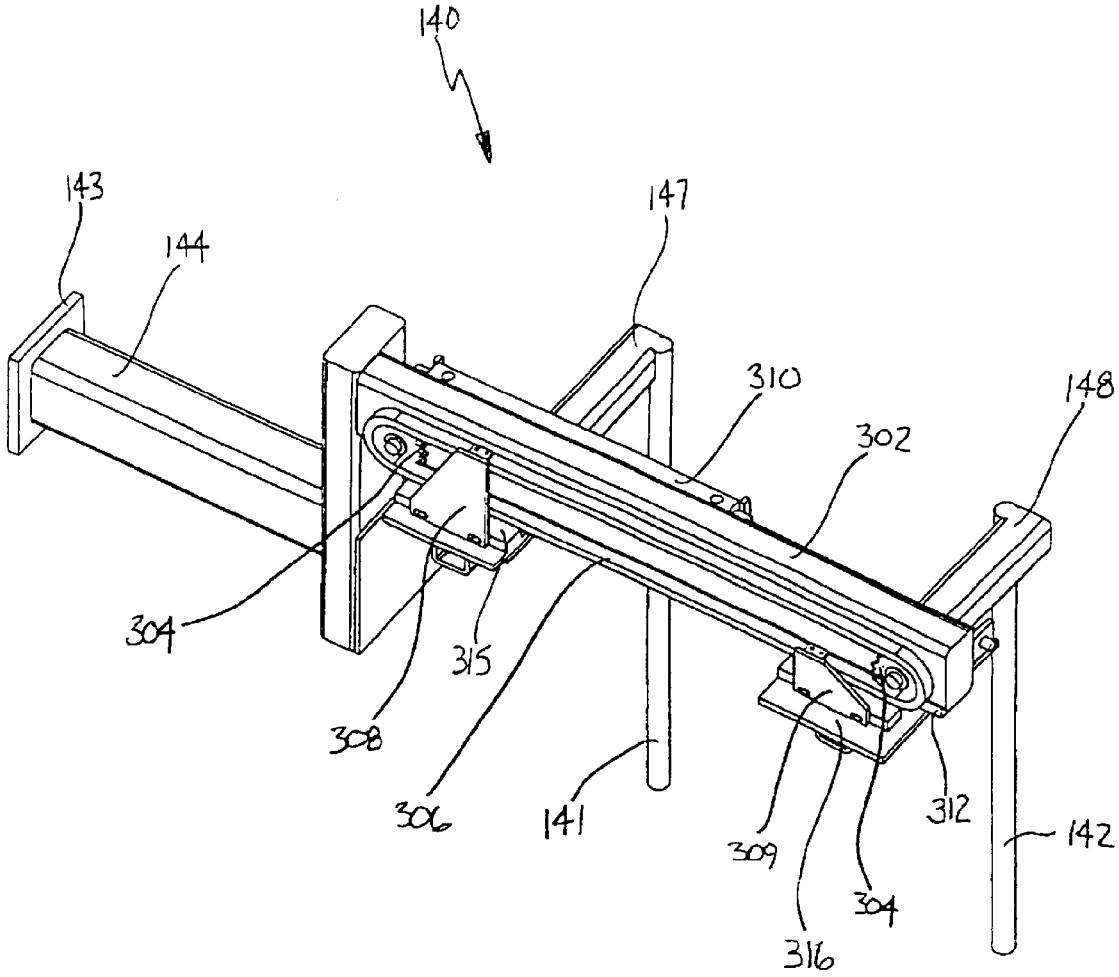
FIG. 24 is a perspective view illustrating a spreader bar assembly constructed according to the principles of the present invention.

A preferred embodiment of spreader bar assembly 140 is illustrated in FIG. 24. Spreader bars 141 and 142 are preferably mounted to first and second moveable arms 147 and 148, respectively, preferably in a substantially opposing or parallel orientation. Arms 147 and 148 are fixed to base units 315 and 316, respectively, which traverse along track 312 provided on frame member 302. Frame 302 is couple to mount arm 144 having mount plate 143 for attaching to spreader bar assembly carriage 230 (see FIG. 12) of lift assembly 114.

In a preferred embodiment, frame 302 is provided with drive belt or chain 306 supported on rotating sprockets 304. Base units 315 and 316 are preferably attached to opposite sides of drive chain 306 using attaching brackets 308 and 309 as shown. With base units 315 and 316 attached to drive chain in this manner, a linear actuating air or hydraulic cylinder 310 can be used to drive one of base units 315 or 316 in a first direction and the other of the base units will have corresponding movement in a direction opposite to that of the first direction. Accordingly, spreader bars 141 and 142 can be extended apart or drawn together as desired by activating a single cylinder.

Figure 25:
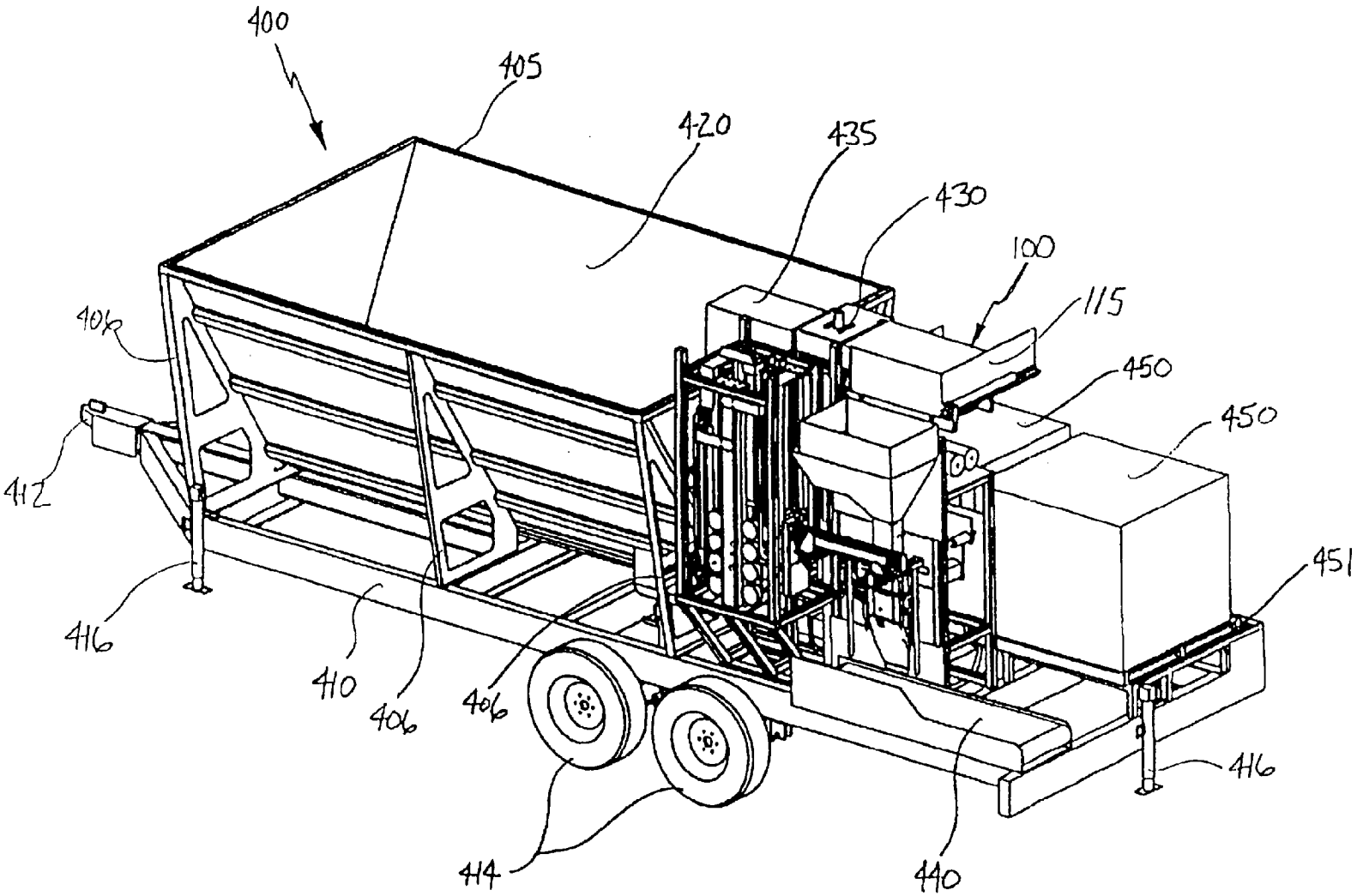
FIGS. 25 and 26 are perspective views illustrating a portable or mobile automatic bag filling apparatus constructed according to the principles of the present invention.
Figure 26:
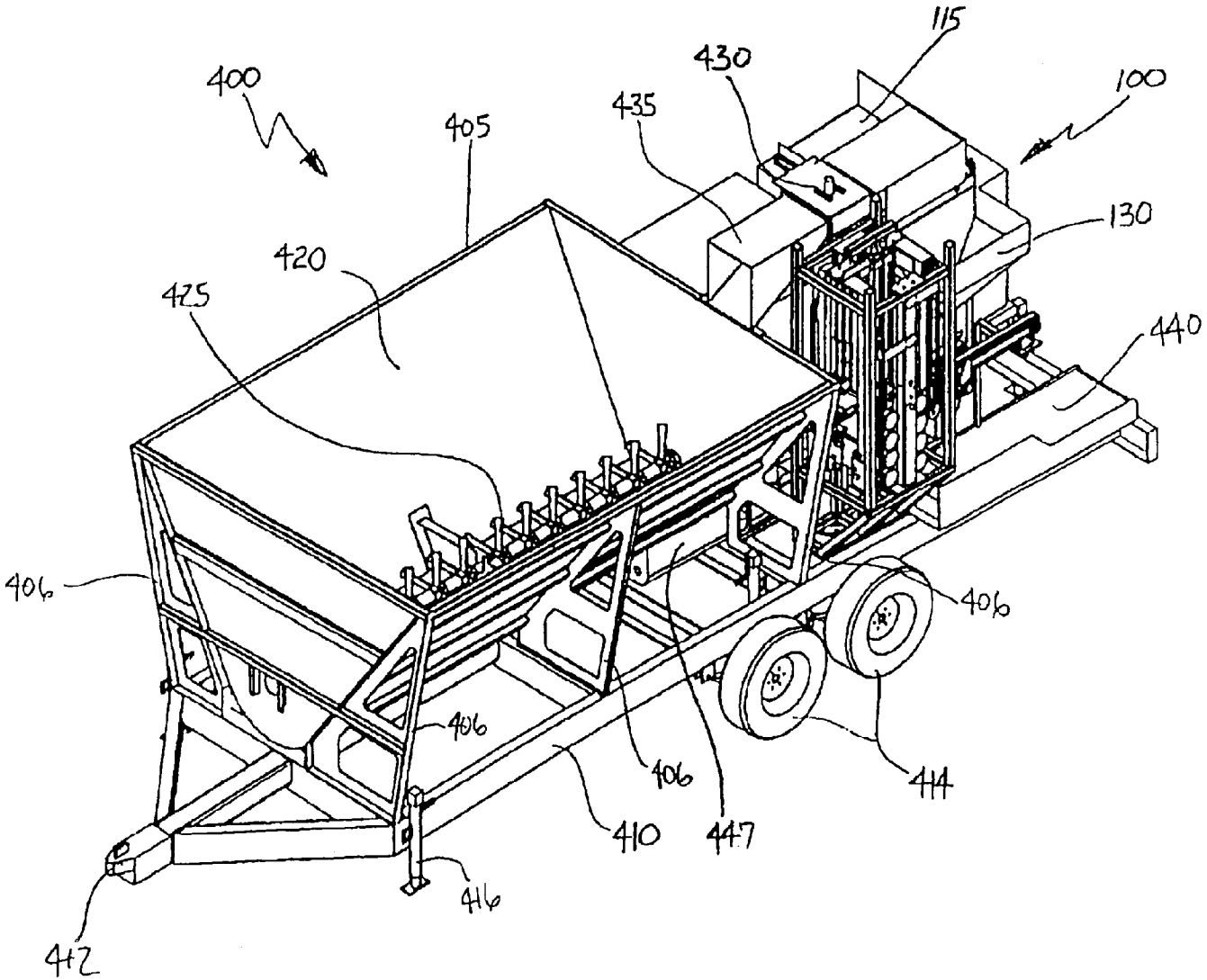
Figure 27:
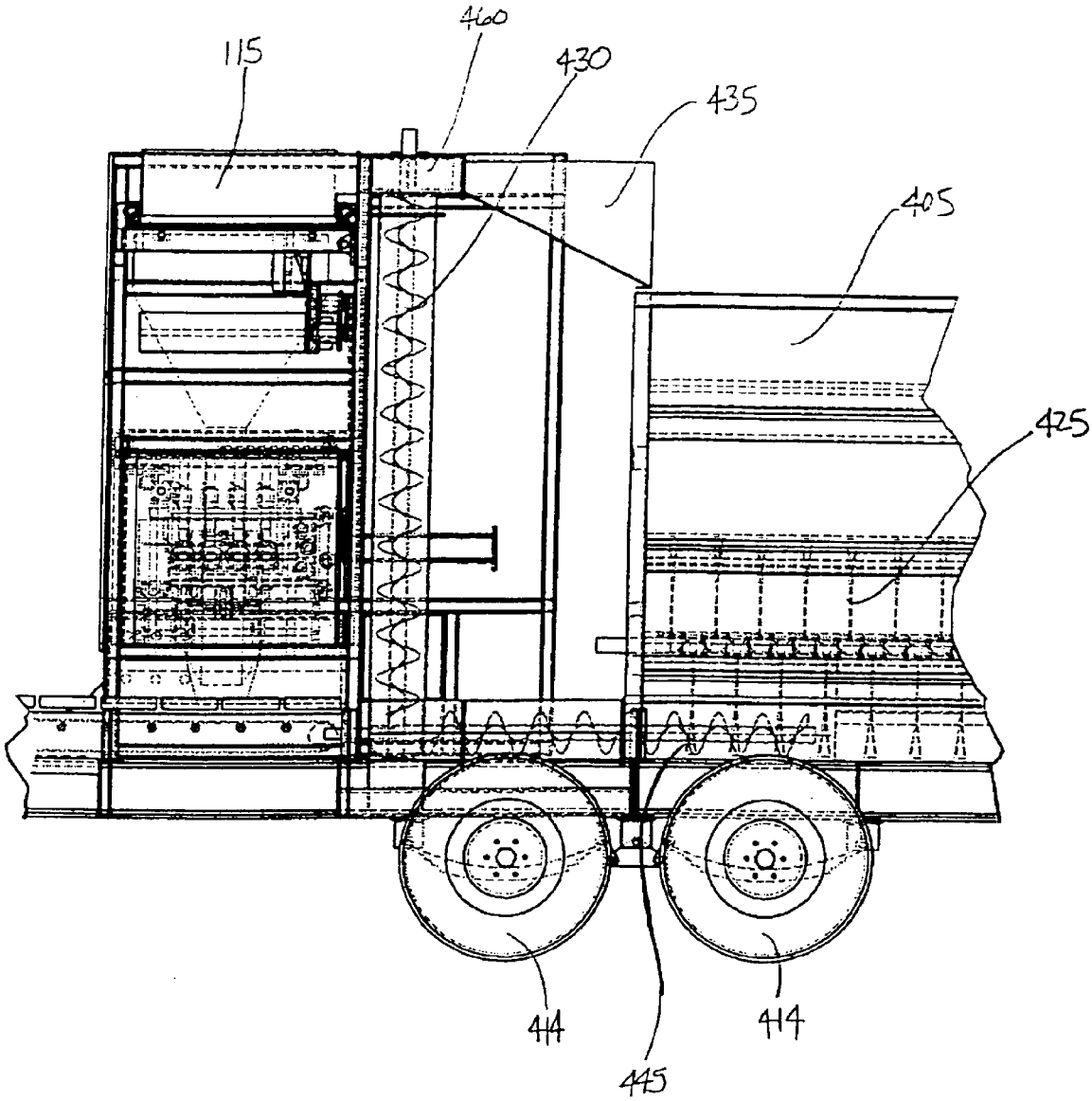
FIG. 27 is a back plan view illustrating a portion of the mobile automatic bag filling apparatus of FIGS. 25 and 26.

The various embodiments of automatic sand bag filling system 100 can be mounted on a truck, tractor, trailer, barge, or other mobile apparatus to allow it to be transported to remote locations, for example to produce filled sand bags at or near a flood site. Mobile filling system 400 having a trailer type construction is illustrated in FIGS. 25–27. In a preferred embodiment, mobile filling system 400 may include a trailer assembly 410 having automatic sand bag filling system 100 securely fixed thereto. Trailer assembly preferably has one or more wheeled axels 414 and a hitch assembly 412 of standard construction to mate with a standard ball hitch (not shown) on a suitable tow vehicle. Trailer 410 may have one or more leveling jacks 416 situated thereon so that the trailer assembly and automatic sand bag filling system 100 can be leveled for during filling operations.

The operation of automatic sand bag filling system 100 for automatically filling a plurality of interconnected sand bags may be substantially the same as described above. The interconnected bags are preferably supplied in bag stacks 450 provided on pallets 451, one or more of which may be placed on trailer assembly 410 to supply automatic sand bag filling system 100 with a sufficient amount of bags to provide for extended periods of uninterrupted operation. A conveyor 440 may be provided below the sand bag filling area to displace or carry away each filled sand bag a sufficient distance to allow the next bag to be filled. Conveyor 440 may transport the bags to further conveyors, dump trucks, front loaders, manual operators, etc. as may be desired.

Mobile filling system 400 preferably has a bulk sand reservoir or hopper 405 for depositing a large quantity of bulk sand to be supplied to automatic sand bag filling system 100. Bulk hopper 405 is securely mounted to trailer assembly 410 and generally has angled or sloping walls 420 and is preferably supported by a number of supports 406. Sloping walls 420 tend to direct the sand deposited in bulk hopper 405 under the force of gravity to the bottom apex region of the hopper where it may easily picked up and delivered from bulk hopper 405 by way of one or more bulk transfer devices.

In a preferred embodiment, first rotating auger 425 is provided in bulk hopper 405 for moving the bulk sand deposited therein generally toward the end of bulk hopper 405 closest to automatic sand bag filling system 100. A second auger 445 displaces bulk sand from within bulk hopper 405 and through auger channel 447 where it is picked up by vertical elevator 430 and raised to bulk distribution head 460. Vertical elevator 430 may be any suitable auger, screw pump, pressure or vacuum transfer device, conveyor, bucket conveyor, centrifugal discharge belt type elevator, or the like. Preferably, vertical transfer device 430 is a screw elevator such as a Type 7 Superscrew Elevator or a centrifugal discharge belt such as a Series 100 Centrifugal Discharge Belt, both commonly manufactured by Martin Sprocket and Gear, Inc. of Arlington, Tex.

The sand transferred by vertical elevator 430 may be oriented to place sand directly into dump assembly 115 or the sand may be routed to dump assembly 115 using a reversible flat conveyor by bulk or other distribution device. Preferably, the sand is transferred to dump assembly 115 by bulk distribution head 460. In a preferred embodiment, bulk distribution head 460 is constructed to selectively discharge the sand to either dump assembly 115 or to return chute 435 which routes the sand back into bulk hopper 405. Depending on the capabilities of the particular vertical elevator, it may be desirable to simply have bulk distribution head 460 return excess sand to bulk hopper 405 rather than attempting to operate the vertical elevator at a slower speed or in a start and stop mode, such as when automatic sand bag filling system 100 has been paused is for some other reason requiring less sand than what is being delivered by vertical elevator 430.

Figure 28:
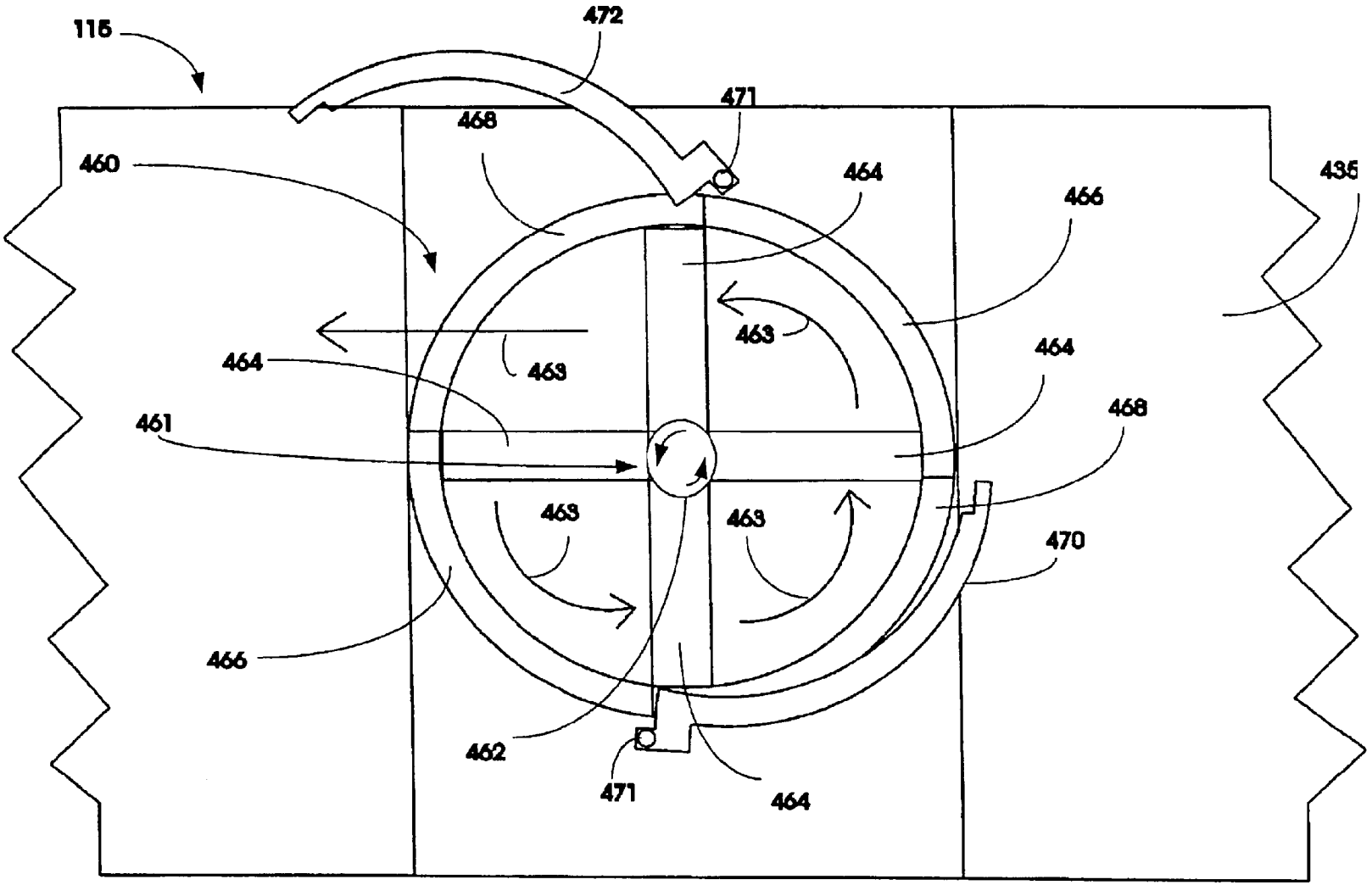
FIG. 28 is a cross-sectional view illustrating a preferred particulate distribution member.

A preferred embodiment of bulk distribution head 460 is illustrated in cross-section in FIG. 28. At the top of vertical elevator 430, bulk distribution head 460 has a rotating head assembly 461 having a plurality of vane members 464. Fixed housing 466 is disposed about rotating head assembly 461 in generally a concentric relationship. Fixed housing 466 has first and second moveable portions 470 and 472 which in an opened position create openings 468 through fixed housing 466. Moveable portions 470 and 472 may move up and down vertically, may slide generally concentric with fixed housing 466, or may pivot as shown about hinge elements 471.

In operation, rotating head assembly 461 is rotated in the direction indicated by arrow 462 to urge sand through bulk distribution head 460. When moveable portion 470 is closed against fixed housing 466 and moveable portion 472 as been actuated into an open position relative to fixed housing 466, rotation of rotating head assembly 461 causes sand to be displaced as indicated by arrows 463 into dump assembly 115. When moveable portions 270 and 272 are reversed, that is moveable portion 272 is closed and moveable portion 270 is opened, the sand instead is displaced into return chute 435. In an alternate embodiment, a second automatic sand bag filling system may be added and supplied sand through chute 435 instead of returning to bulk hopper 405. Thus bulk distribution head 460 is capable of selectively supplying more than one automatic sand bag filling system.

Figure 29:
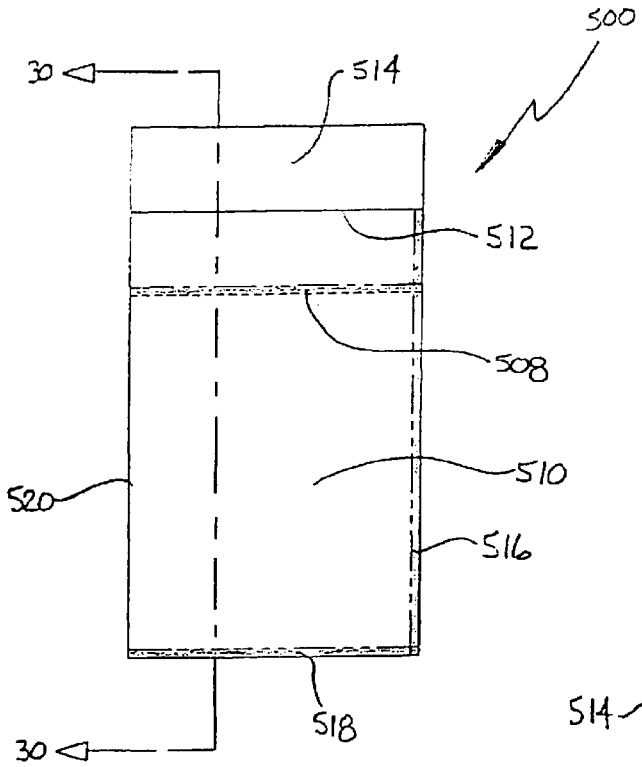
FIG. 29 is a top plan view illustrating a particulate bag constructed according to the principles of the present invention.
Figure 30:
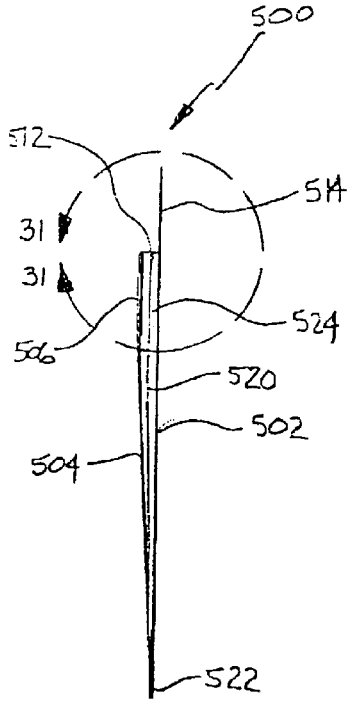
FIG. 30 is a cross-sectional view taken along line 30—30 as shown in FIG. 29.
Figure 31:
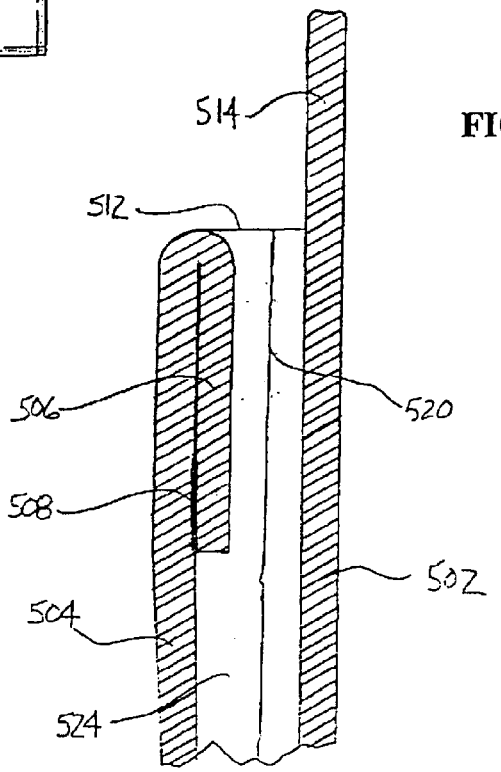
FIG. 31 is a cross-sectional detail view of the area indicated by line 31—31 as shown in FIG. 30.

A preferred bag constructed according to the principles of the present invention is illustrated in FIGS. 29–31. Sand bag 500 preferably has a back panel or section 502 and a front panel section 504 which are sealed on three sides and having at least a partially open fourth side through which sand may be deposited. In a preferred embodiment, front section 502 and back section 504 are made from a generally single piece of material which is folded over with front section 502 being folded over onto back section 504 along fold 520. Side sealed portion 516 and bottom sealed portion 518 are then created by stitching, gluing, heat sealing, or by any suitable mechanical fastener or sealing technique. The top of the bag is left unsealed to provide bag opening 512.

In a preferred embodiment, a portion or flap 506 of the front section 502 is folded over towards the bottom 522 of bag 500 and sealed to the front section 502 at sealed portion 508. Flap 506 is preferably folded towards the interior 524 of bag 500 but may alternatively be folded to the outside as well. With flap portion 506 folded in this manner, bag 500 has a central portion 510, generally for holding the contents placed within bag interior 524, and an extended portion 514 of back section 502. Extended portion 514 provided a convenient point or attachment for connecting to the bottom of an adjacent bag to form a series of interconnected bags. When the bags are interconnected in this way, the bags may be severed after filling through extended portion 514, and once severed, all or a portion of extended portion 514 may be folded over bag opening 512 and secured by any convenient means to close or seal shut bag opening 512, preferably in the manner generally described above with reference to FIG. 20.

Figure 32:
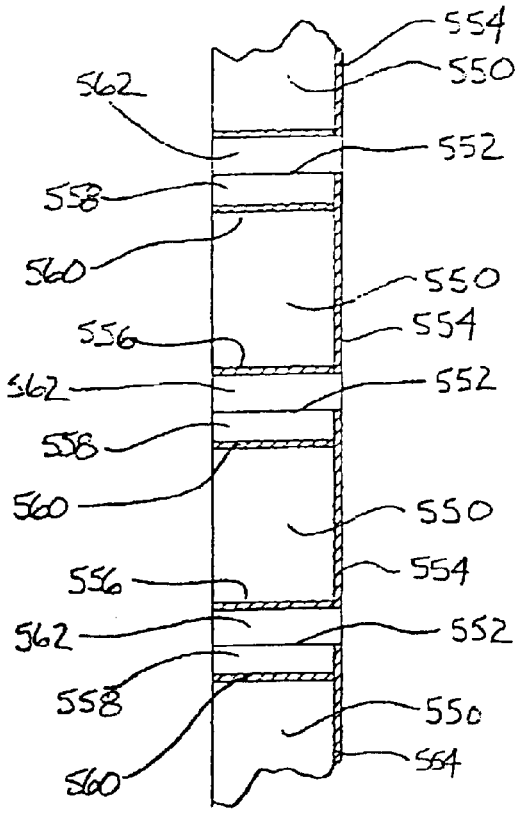
FIG. 32 is a top plan view illustrating a plurality of bags arranged in a continuous fashion according to the principles of the present invention.

A plurality of bags 500 may be interconnected together in any suitable manner including sewing or stitching, stapling, gluing, heat bonding, or by use of other suitable mechanical joining or fastening devices or techniques. In a preferred embodiment, a plurality of bags are formed in an interconnected fashion from a single, generally continuous strip or web of suitable bag material as seen in FIG. 32. The plurality of interconnected bags 550 each preferably have a side and bottom seals 554 and 556, respectively, and a substantially unsealed bag opening 552 through which sand or the like may be deposited. The common bag material provides interconnecting portions 562 between each bag 550.

Figure 33:
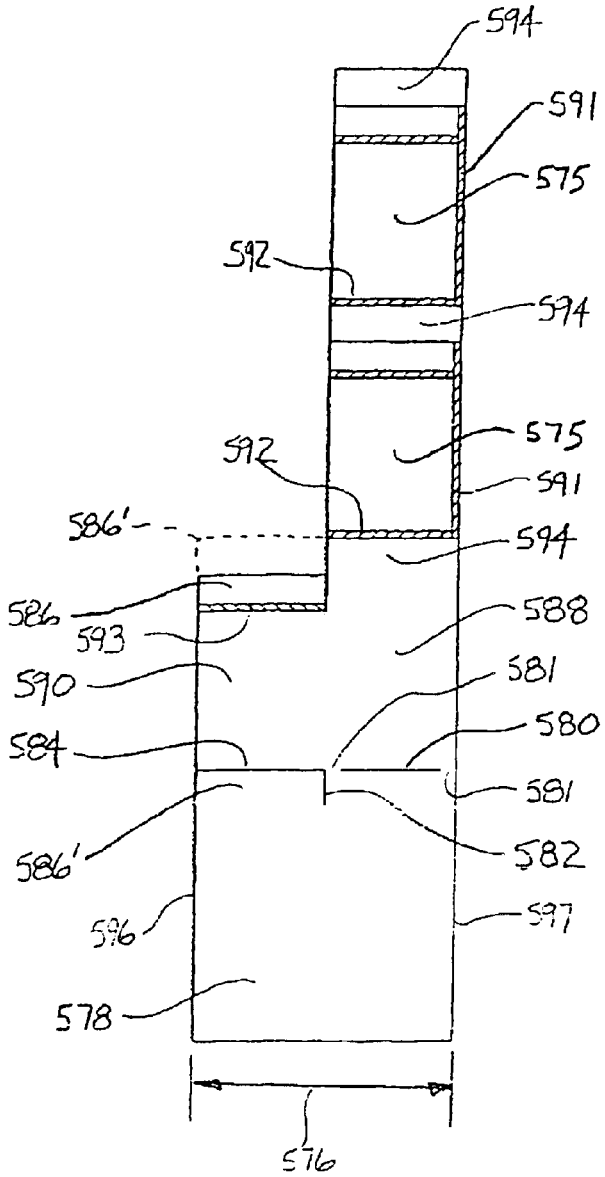
FIG. 33 is a top plan view illustrating the steps of a preferred method of forming a series of interconnected bags.
Figure 34:
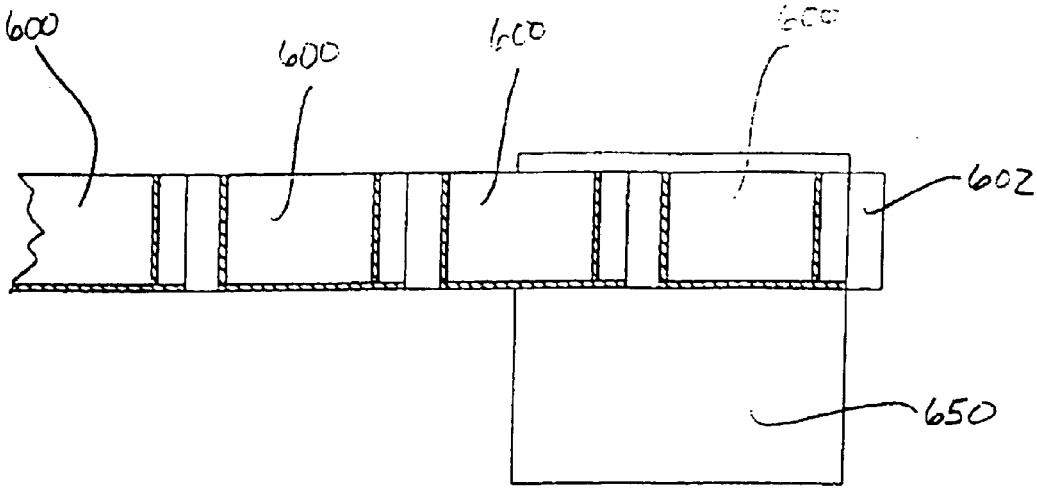
FIGS. 34 and 35 are top and front plan views, respectively, illustrating a preferred method of placing a web of interconnected bags onto a pallet.
Figure 35:
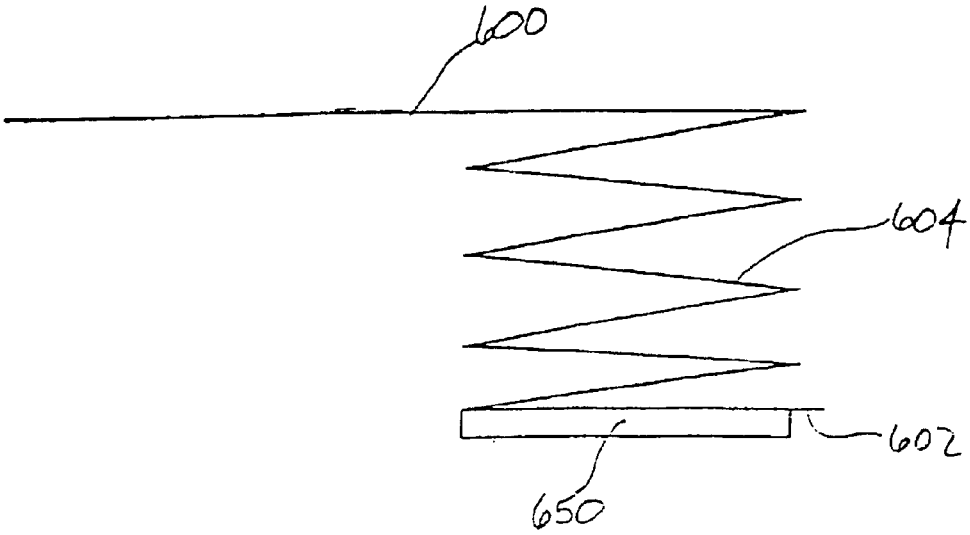

A preferred method of making a plurality of interconnected bags is illustrated in FIG. 33. Starting with a length or continuous web of suitable bag material 578 having a width 576, a first cut 584 is made from first edge 596 towards the center of bag material 578, preferably substantially perpendicular to first edge 596 and extending across approximately one-half of width 576. A second cut 582 is made, preferably in substantially parallel to first edge 596. First and second cuts 584 and 582 (which may of course be a single cut) generally form a flap 586' which is preferably folded over to form flap 586 and attached at sealed or connected portion 593. First and second cuts 584 and 582 are generally shown as having a right angle L-shape, but may vary significantly therefrom.

Once flap 586 has been folded and secured, a first or portion 590 of bag material 579 is folded over onto the remaining portion 588, thus forming top and back panels or portions of bag 575. The folded assembly is closed or sealed at a bottom sealed portion 592 and side sealed portion 591, thus forming a series of bags 575 having integral connecting portions 594 therebetween. Connecting portions 594 allow the bags to be continuously ted in this end to end fashion through an automated filling system, such as automatic sand bag filling system 100.

To make it easier to release one bag from an adjacent bag, one or more cuts, slits, or perforations may optionally be formed in that portion of bag material 579 that will become the interconnecting portions 594. In a preferred embodiment, cut 580 is placed substantially even with cut 584, leaving interconnected portions 581 in tact. In this configuration, instead of having to sever the entire connecting portion 594 after the bag has been filled, only portions 581 need be severed to release the bag for the adjacent bag. In a preferred embodiment, portions 581 are wide enough to allow bags 575 to remain securely connected under the tension required for automated feeding and filling. Preferably, cut 580 is less than one-half of width 576, most preferably leaving connected portions having a width in the range of about 0.5 inches to about 3.0 inches, most preferably about 1.5 inches to about 2.5 inches, most preferably about 2.0 inches.

The bag material may be of any commercially available material having sufficient strength to securely hold the contents placed therein under the particular conditions of use. When the bag of the present invention is to be used as a sand bag, appropriate materials may include burlap, polypropylene or other woven or sheet polymeric material, rice paper, polymeric coated papers or woven materials, or other suitable bag material or composite thereof.

For use as sand bags, width 576 may preferably be in the range from about 20 inches to about 48 inches, more preferably in the range from about 28 inches to about 40 inches, most preferably about 34 inches. The height of each bag from the bottom to the top opening may preferably be in the range from about 15 inches to about 40 inches, more preferably in the range from about 20 inches to about 36 inches, most preferably about 27 inches. Connection portions 594 may preferably be in the range of about 2 inches to about 12 inches, more preferably in the range of about 3 inches to about 8 inches, most preferably about 5 inches.

The interconnected bags as described with reference to FIGS. 32 and 33 are preferably prepared and stored in a manner which allows them to be continuously fed into an automated filling apparatus, such as automatic sand bag filling apparatus 100. In a preferred embodiment, a series of interconnected bags 600 are directed over a pallet assembly 650 and caused to be arranged in fanfold configuration 604. Preferably, an end flap or portion 602 of the first bag is left to extend out from the resulting stack of bags. Portion 602 may be connected directly to an adjacent pallet of bags to provide for a substantially continuous stream of interconnect bags.

Figure 36:
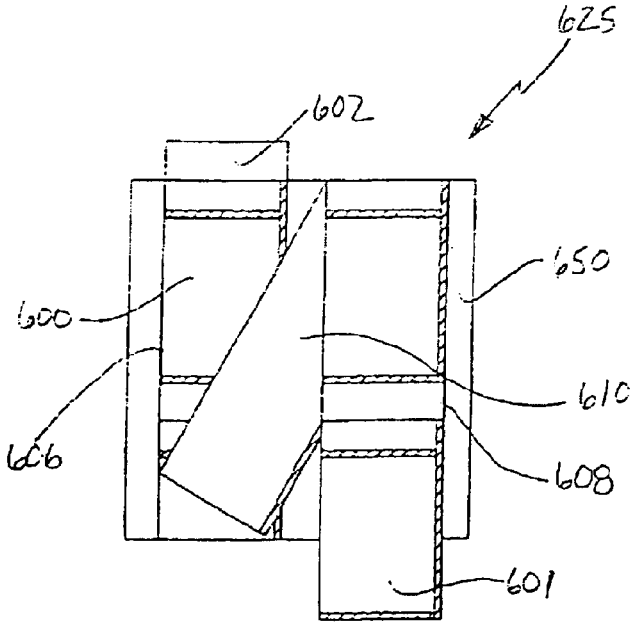
FIGS. 36, 37, and 38 are top, front, and side plan views, respectively, illustrating a preferred arrangement of palletized bags according to the principles of the present invention.
Figure 37:
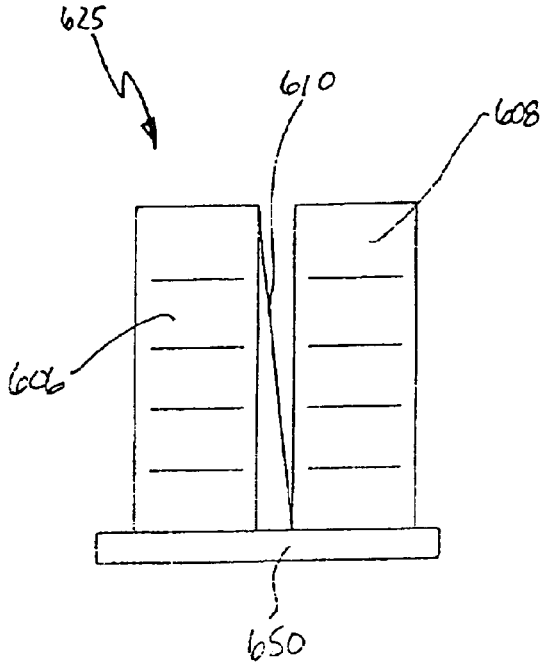
Figure 38:
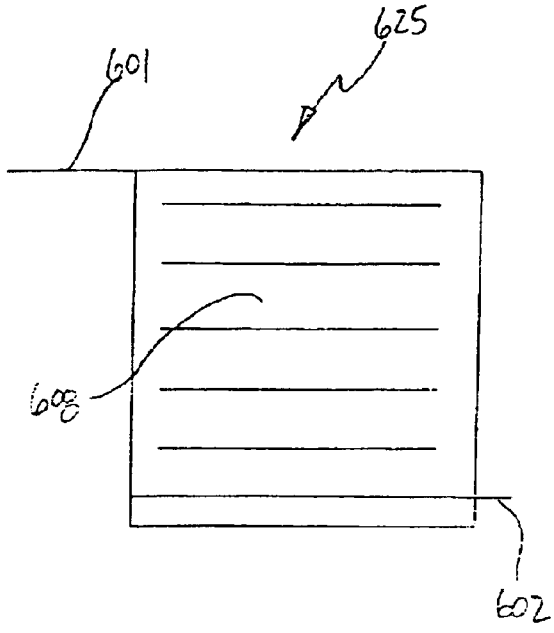

In a preferred embodiment, a single pallet may have a series of interconnected bags arranged two or more fan-fold stacks which are serially connected to provide for continuous feeding into an automated filling machine. Referring to FIGS. 36–38, interconnected bags 600 are arranged in a fan-fold configuration forming first stack 606 on pallet 650. The first bag at the bottom of stack 606 has portion 602 extending outwards from under first stack 606. A transition portion 610 extends from the top of first stack 606 to begin the bottom of second stack 608. End bag 601 at the top of second stack 608 may be fed into an automated filling machine, which preferably caused interconnected bags 600 to continuously feed into the filling machine until both of stacks 606 and 608 have been exhausted.

Figure 39:
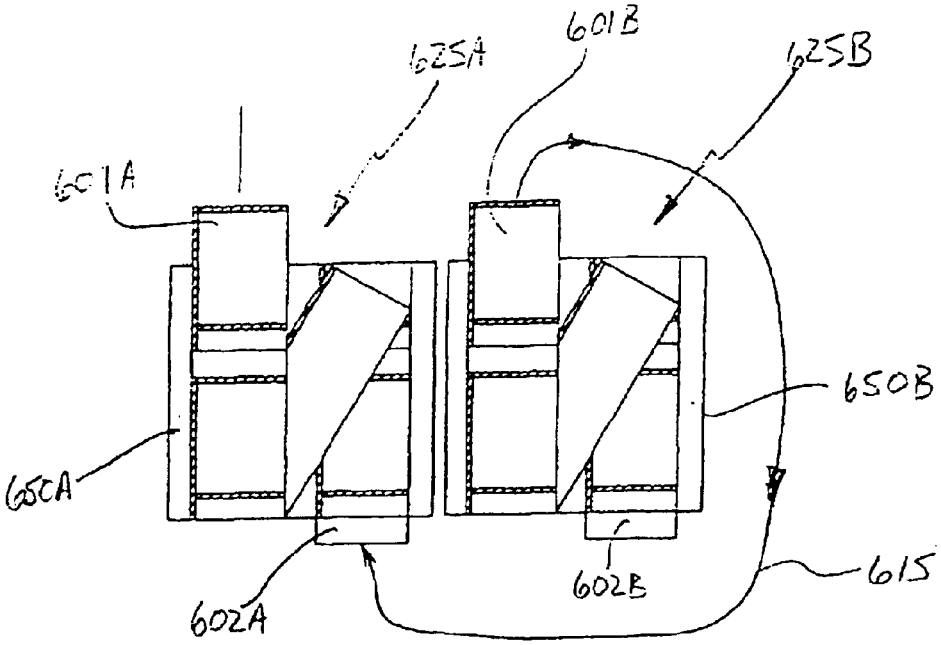
FIG. 39 is a top plan view illustrating a preferred method of connecting two or more palletized bag assemblies to facilitate an uninterrupted supply of bags to an automatic filling apparatus.

Referring to FIG. 39, two or more palletized bag assemblies 625A and 625B can be sequentially fastened together. Pallets 650A and 650B may be placed adjacent to each other. Before or after first bag 601A is fed into the filling machine, first Bag 601B is unfolded a sufficient amount to allow it to be attached or secured to portion 602A extending from palletized bag assembly 625A as generally indicated by arrow 615. The attachment is preferably made by sewing or stitching but could be made using any other attaching means or technique. Further palletized bag assemblies can be added as desired, the next one attaching to portion 602B in the same manner as just described. The capability to sequentially chain the bags together allows the machine to be operated continuously without any downtime required to load bags.

Figure 40:
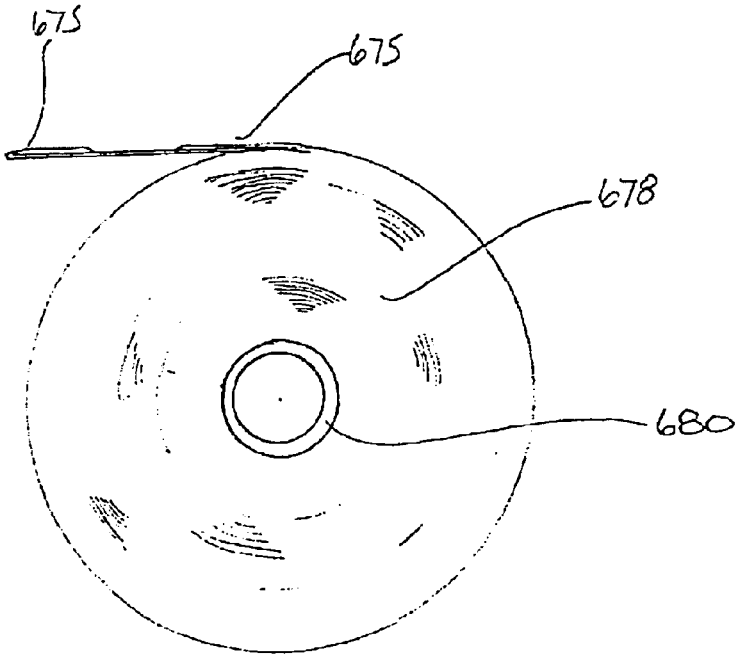
FIG. 40 is a front plan view illustrating a plurality of interconnected bags supplied on a roll.

FIG. 40 illustrates an alternative arrangement for supplying a relatively large number of interconnected bags to an automated filling machine. Interconnected bags 675, preferably of a construction as described above, may be wound or rolled up onto a core 680 to form a continuous roll of bags 678. Core 680 may be placed onto a drive shaft or spindle which allows roll 678 rotate as bags 675 are fed out into the filling machine.

In operation with automatic sand bag filling system 100, a palletized supply of interconnected bags as just described are preferably fed through tension roll assembly 125 and over back plate 122 into a position where a bag may be engaged by fill channel 132 of the raised fill hopper assembly 130. As fill channel 132 is lowered, the bag is brought to a fill position. The bag may be supported and tension by way of articulating spreader bars positioned with the interior of the bag.

A charge of sand is delivered into fill hopper assembly 130 where it remains contained within fill channel 132 which is positioned in the interior of the bag. Subsequently, fill channel 132 is withdrawn to release the sand into the bag. The top portion of the bag is then clamped and the bag is separated from the adjacent bag to which it has been attached and is closed or sealed shut. The clamps are released and the bag is removed manually or by conveyor from the fill position. The sequence is repeated as the next bag is engaged and advanced by fill channel 132.

While certain embodiments are illustrated in the drawings and have just been described herein, it will be apparent to those skilled in the art that many modifications can be made to the embodiments without departing from the inventive concepts described. For purposes of illustration only, the principles of the present invention has been generally described with reference to the context of filling bags with sand but may readily be applied to filling a wide range of flexible receptacles with various particulate matter other than sand. The concepts described herein are equally applicable to many other filling and bulk processing uses as would be apparent to a skilled artisan. Further, the different components of the various exemplar embodiments described above can be combined in any desirable construction. Accordingly, the invention is not to be restricted except by the claims which follow.

What is claimed is:

1. A bag filling apparatus for filing a bag with particulate matter, comprising:

a fill channel having an open end and an interior sized to hold a predetermined amount of particulate matter, said fill channel being moveable along a fixed path from a first position exterior of said bag to a second position wherein at least a portion of said fill channel is positioned within the interior of said bag; and a metering device adapted to deposit said predetermined amount of particulate matter through said open end and into said interior of said fill channel wherein said metering device comprises a moveable tray having a bottom member, said bottom member having at least one opening and a plate member substantially covering said at least one opening when said moveable tray is in a first position, said moveable tray being moveable relative to said plate member to a second position in which said at least one opening is positioned at least partially over said open end and at least a portion of said at least one opening is no longer covered by said plate member.

2. The bag filling apparatus of claim 1 wherein said bottom further comprises a contiguous bottom portion adjacent said at least one opening and said moveable tray further comprises an input opening for receiving a substantially continuous supply of particulate matter, said supply of particulate matter directed onto said plate member when said moveable tray is in said first position and said supply of particulate matter being directed onto said contiguous bottom portion when said moveable tray is in said second position.

3. The bag filling apparatus of claim 1 further comprising a means for monitoring the weight of particulate matter accumulated on said moveable tray.

4. A bag filling apparatus for filling a bag with particulate matter, comprising:

a fill channel having an open end and an interior sized to hold a predetermined amount of particulate matter, said fill channel being moveable along a fixed path from a first position exterior of said bag to a second position wherein at least a portion of said fill channel is positioned within the interior of said bag; and a support member having first and second elongate members moveably coupled thereto; said support member being moveable from a first position wherein said first and second elongate members are positioned exterior of said bag and a second position wherein at least a portion of said first and second elongate members are positioned within the interior of said bag, at least one of said first and said second elongate members being moveable relative to the other whereby said first and second elongate members may be spread apart relative to each other within said bag, wherein said first and second elongate members are substantially cylindrical.

5. The bag filling apparatus of claim 4 wherein said elongate members are oriented substantially parallel to each other.

6. The bag filling apparatus of claim 1 wherein the open end of said fill channel is funnel shaped.

7. The bag filling apparatus of claim 1 wherein said fill channel further comprises a second end having at least one opening through which particulate matter is allowed to exit from said interior.

8. The bag filling apparatus of claim 7 wherein a substantial portion of the particulate matter exits said interior through said at least one opening when said fill channel is moving from said second position to said first position.

9. An automatic bag filling system comprising:

a plurality of interconnected bars each having a bag opening and a bag interior wherein each of said plurality of bags have a top portion and a bottom portion, the top portion of each of said plurality of bags being connected to the bottom portion of a next adjacent bag;

a fill channel having a first end with an inlet opening for receiving particulate matter, a second end having an outlet opening, and a substantially open interior region therebetween said second end being positionable within each of said interconnected bags, wherein said fill channel is moveable between at least a first position exterior of one bag of said plurality of bags placed at a first location, a second position wherein at least a portion of said fill channel is positioned within the interior of said one bag; and a third position wherein said one bag is displaced by said fill channel to a second location; and a metering device adapted to deposit a desired quantity of particulate matter within said inlet opening.

10. The automatic bag filling system of claim 9 wherein said fill channel is moveable to a fourth position wherein said fill channel is exterior of said one bag at said second location.

11. The automatic bag filling system of claim 9 further comprising a lift assembly having a carriage controllably positionable along a fixed vertical path corresponding with said first, second, and third positions of said fill channel, said fill channel being operably connected to said carriage.

12. The automatic bag filling system of claim 10 wherein a substantial portion of said quantity of particulate matter exits said fill channel through said outlet opening as said fill channel is moving from said third position towards said fourth position.

13. The automatic bag filling system of claim 9, wherein said first location is vertically above said second location.

14. The automatic bag filling system of claim 13 wherein said first location and said second location are separated by a distance substantially equal to the length of said one bag.

15. The automatic bag filling system of claim 10 wherein said first position, said second position, and said third position are in a substantially straight line.

16. The automatic bag filling system of claim 9 wherein said metering device comprises a moveable tray.

17. The automatic bag filling system of claim 9 wherein said first end is funnel-shaped.

18. The automatic bag filling system of claim 9 further including a trailer assembly having two or more wheels.

19. The automatic bag filling system of claim 18 wherein said trailer assembly further comprises a hopper sized to hold a sufficient quantity of particulate matter to fill said plurality of interconnected bags.

20. The automatic bag filling system of claim 19 further comprising a bulk transfer device to distribute particulate matter from said hopper to said metering device.

21. A method for filling a series of bags with particulate matter comprising:

providing the plurality of bags, said bags having a bag opening end and a bag bottom end and being connected in an end to end fashion;

providing a fill channel having a first end having and inlet opening, a second end having an outlet opening, and a substantially open interior therebetween;

placing at least a portion of said second end within the interior of one of said plurality of bags such that said outlet opening is in close proximity to said bag bottom end of said one bag;

depositing a desired amount of particulate matter within said interior of said fill channel; and withdrawing said fill channel from within the interior of said one bag to release said amount of particulate matter from said interior of said fill channel and into said interior of said bag to fill said bag with said amount of particulate matter.

22. The method of claim 21 further comprising the step of cutting said one bag from a next bag adjacent thereto after said release of said amount of particulate matter into said interior of said one bag.

23. The method of claim 21 further comprising the step of mechanically closing said bag opening.

24. The method of claim 21 further comprising the steps of:

placing at least a portion of said second end within the interior a next bag adjacent to said one bag such that said second end is urged against said bag bottom of said next bag;

moving said fill channel to cause said second end of said fill channel to displace said next bag from a first position to a second position; and depositing a second desired amount of particulate matter within said interior of said fill channel.

* * * * *